US005103244A

United States Patent [19]

Gast et al.

[11] Patent Number: 5,103,244

[45] Date of Patent: Apr. 7, 1992

[54] METHOD AND APPARATUS FOR CLEANING INK-JET PRINTHEADS

[75] Inventors: Paul D. Gast, Vancouver, Wash.; Walter Uebelacker, Boise, Id.; J. P. Harmon, Washougal, Wash.

[73] Assignee: Hewlett-Packard Company, Palo Alto, Calif.

[21] Appl. No.: 549,583

[22] Filed: Jul. 5, 1990

[51] Int. Cl.[5] ..... B41J 2/165

[52] U.S. Cl. ..... 346/1.1; 346/140 R

[58] Field of Search ..... 346/140, 1.1

[56] References Cited

U.S. PATENT DOCUMENTS

| | | | |
|---|---|---|---|
| 4,436,439 | 3/1984 | Koto | 346/140 X |
| 4,577,203 | 3/1986 | Kawamura | 346/140 |
| 4,745,414 | 5/1988 | Okamura | 346/140 |
| 4,853,717 | 8/1989 | Harmon et al. | 346/140 |
| 4,959,673 | 9/1990 | Noda | 346/140 |
| 4,977,459 | 12/1990 | Ebinuma | 346/140 X |

FOREIGN PATENT DOCUMENTS

| | | |
|---|---|---|
| 3870 | 1/1983 | Japan . |
| 194557 | 11/1983 | Japan . |
| 45163 | 3/1984 | Japan . |
| 77943 | 4/1987 | Japan . |
| 251145 | 10/1987 | Japan . |

*Primary Examiner*—Joseph W. Hartary

[57] ABSTRACT

A method and apparatus for cleaning the orifice plates of multiple printheads of an ink-jet printer. The apparatus includes a multi-blade wiper which is indexed automatically to permit each printhead to be wiped in sequence by a selected blade. The desired cleaning is produced by dragging a printhead across the selected wiper blade. The wiper mechanism may also comprise a plurality of resilient blades each having an octagonal shape and rotatable about an axis. A cam coupled to the printhead carriage causes simultaneous pivoting of the wiper blades into contact with the printheads as well as rotation of the blades to facilitate cleaning thereof. In the method of this invention, ink is expelled from the printheads to rehydrate dried ink thereon to facilitate its removal.

36 Claims, 16 Drawing Sheets

METHOD AND APPARATUS FOR CLEANING INK-JET PRINTHEADS

FIELD OF THE INVENTION

This invention relates generally to ink-jet printers and printheads, and more particularly to a method and apparatus for automatic cleaning of ink-jet printheads.

BACKGROUND OF THE INVENTION

The orifice plate of the printhead of an ink-jet printer, particularly a thermal ink-jet printer, tends to pick up contaminants, such as paper dust, and the like, during the printing process. Such contaminants adhere to the orifice plate either because of the presence of ink on the printhead, or because of electrostatic charges. In addition, excess dried ink can accumulate around the printhead, particularly if all the ink is not pumped out of the printhead. The accumulation of either ink or other contaminants can impair the quality of the output by interfering with the proper application of ink to the printing medium. In addition, if color pens are used, each printhead may have different nozzles which each expel different colors. If ink accumulates on the orifice plate, mixing of different colored inks can result during use. If colors are mixed on the orifice plate, the quality of the resulting printed product can be affected. For these reasons, it is desirable to clear the printhead orifice plate of such contaminants and ink on a routine basis to prevent the build up thereof. Furthermore, the nozzles of an ink-jet printer can clog, particularly if the pens are left uncapped in an office environment.

Many prior art ink-jet printers use a vacuum pump or the like to prime the printhead, and to remove clogs. However, when color pens are used, a separate pump is required for each set of nozzles of the same color to avoid color mixing. The provision of several separate pumps unduly complicates the mechanism, rendering it more prone to failure, and more expensive.

The clearing of clogged nozzles, and the removal of contaminants, such as paper dust and dried ink from the orifice plate of the printhead nozzle is particularly difficult where a color printhead and a black printhead both are present on the same printhead carriage. In existing wiper systems, such as those described in U.S. Pat. Nos. 4,872,026, and 4,577,203, each wiper blade scrapes each printhead on the printhead carriage. Thus, if one were to have both a black printhead and a color printhead on the same carriage, the same blades would wipe contaminants and dried ink off both printheads. Under these conditions, contamination of the black printhead with colored ink, and of the colored printhead with the black ink is highly likely, thus interfering with the print quality.

Furthermore, existing wiper systems such as those shown in the foregoing patents which utilize only a mechanical wiping action are generally not capable of completely removing dried ink from the orifice plate of a printhead. Dried ink becomes a particular problem with pens which have been in service for a long period of time.

Some of the foregoing problems are overcome by the rotary wiper disclosed in U.S. application Ser. No. 07/463,755, filed on Jan. 12, 1990, and assigned to the Assignee of the present application. However, such a configuration is not always suitable when both black and color printheads are provided in the same carriage, because of the potential for mixing of the inks. Furthermore, although this apparatus is effective in removing most contaminants, old dried ink is difficult to remove even with the foregoing apparatus.

It is, therefore, an object of the present invention to provide a wiper for an ink-jet printer having both a color printhead and a black printhead for removal of contaminants without any mixing of the ink from the two printheads.

It is a further object of the present invention to provide a wiper for an ink-jet printer which includes means for automatically cleaning the wiper as it wipes the orifice plate of the printhead.

It is another object of the present invention to provide a simplified wiper mechanism which is effective in removing paper dust, ink and other contaminants from the printhead orifice plate of an ink-jet printer.

It is another further object of the present invention to provide a wiper for an ink-jet printer which is capable of removing dried ink on the printhead orifice plate.

It is yet another further object of the present invention to provide a method for cleaning the orifice plates of printheads of an ink-jet printer in which there are both a color printhead and black printhead on the same carriage.

It is yet another further object of the present invention to provide a method for cleaning dried ink from the orifice plate of an ink-jet printhead.

It is yet another further object of the present invention to provide a service station for an ink-jet printer which does not require a vacuum pump for cleaning and priming of the printheads.

SUMMARY OF THE INVENTION

The above and other objects are achieved in accordance with the present invention which includes a multi-blade wiper which is indexed automatically to permit each printhead to be wiped only by a selected blade which is not used to wipe any other printhead and which utilizes ink expelled from the printhead to rehydrate dried ink to facilitate its removal.

In a first embodiment for a printhead carriage having multiple printheads with different colored inks, preferably the invention comprises a wiper having a plurality of resilient blades extending outwardly from a central axis of rotation and means for indexing a selected blade into position for wiping. The desired cleansing is produced by dragging a selected printhead by movement of the printhead carriage across an associated stationary wiper blade. At least one blade is associated with each printhead. In a preferred embodiment, four blades are provided, two blades being dedicated to wiping the color printhead and two blades being dedicated to wiping the black printhead. The two different pairs of wiper blades have different lengths and their associated printhead has a correspondingly different printhead to paper spacing, so that the color and black printheads can be selectively wiped, without wiping of the other printhead. In this manner, mixing of the inks between the different printheads is avoided. The indexing mechanism typically comprises a lever arm which is actuable by movement of the printhead carriage, and which is associated with a ratcheting mechanism to permit indexing of the wiper in one direction only. A biasing spring returns the arm to its initial position for continued indexing during another pass of the printhead carriage.

A cleaning apparatus is provided for removal of contaminants from the wiper. The cleaning apparatus includes a series of scrapers disposed about the periphery of the wiper at a position spaced from the area in which the printhead orifice is wiped. As the wiper is indexed under normal circumstances, the wiper blades are dragged across the scrapers for removal of ink and other contaminants thereon.

In another aspect of this invention, the wiping mechanism of the first embodiment can be used in either one of two modes. In the first mode, the printhead orifice plate of both the color printhead and the black printhead are both selectively wiped automatically at a preselected stage of the printing operation, for example, at the beginning of each page of text that is printed. Typically, in this mode, the wiper is not wetted with expelled ink during or before the wiping process. The second mode involves the spitting of ink from the printheads onto the wiper blades to assist in rehydrating the dried ink disposed on the printhead orifice plate and a more prolonged and a repeated mechanical scrubbing process. This second mode is typically employed only when the user perceives a decrease in print quality and initiates the procedure manually.

In an alternative embodiment, the wiper mechanism comprises a plurality of resilient blades, each having a plurality of wiping edges which can be rotated or indexed into position as needed. One blade is provided for each printhead to be wiped. Typically, each blade is thin and flexible and has an octagonal shape. Each blade may be indexed about an axis passing through the center of the octagon so that a fresh edge is presented in wiping relation with a printhead for each wiping sequence. In one embodiment, each blade is indexed by a cam disposed on the printhead carriage which actuates a cam follower as the printhead carriage passes thereover. As each blade is indexed, it passes through a blade cleaner which typically includes an absorbent material positioned in contact with the blade to wick away ink, as well as to wipe the blade clean. The blades are normally spaced below the printheads to avoid inadvertent contact when no wiping is desired. When the printheads are disposed above their associated blades for wiping, the blades are raised into wiping contact. Typically, the blades are raised by rotating a shaft containing the blades in response to a movement of the printhead carriage.

The second embodiment, also includes the expelling of ink upon the wiper blades to allow rehydration of the dried ink to facilitate removal thereof. Typically, the ink is expelled upon an associated blade just prior to wiping to prevent excessive color mixing on the printhead orifice of the color printhead. This expelling of ink typically is followed by a series of scrubbing cycles by the wiper blades.

The foregoing wiper apparatus permits selective wiping of each printhead by an associated blade when more than one printhead is disposed on a printhead carriage to prevent contamination of one printhead with the ink from another printhead. In addition, the foregoing apparatus and method facilitates the removal of dried ink from the orifice plates of the printheads and permits cleaning of the printheads without use of a vacuum pump. The particular mechanical configuration of the actuating system provides a simplified and dependable apparatus which is not subject to failure, and which can be simply and inexpensively assembled.

BRIEF DESCRIPTION OF THE DRAWINGS

The objects, advantages and features of this invention will be more clearly appreciated from the following detailed description taken in conjunction with the accompanying drawings in which.

DETAILED DESCRIPTION OF THE PREFERRED EMBODIMENTS

Figure 1:
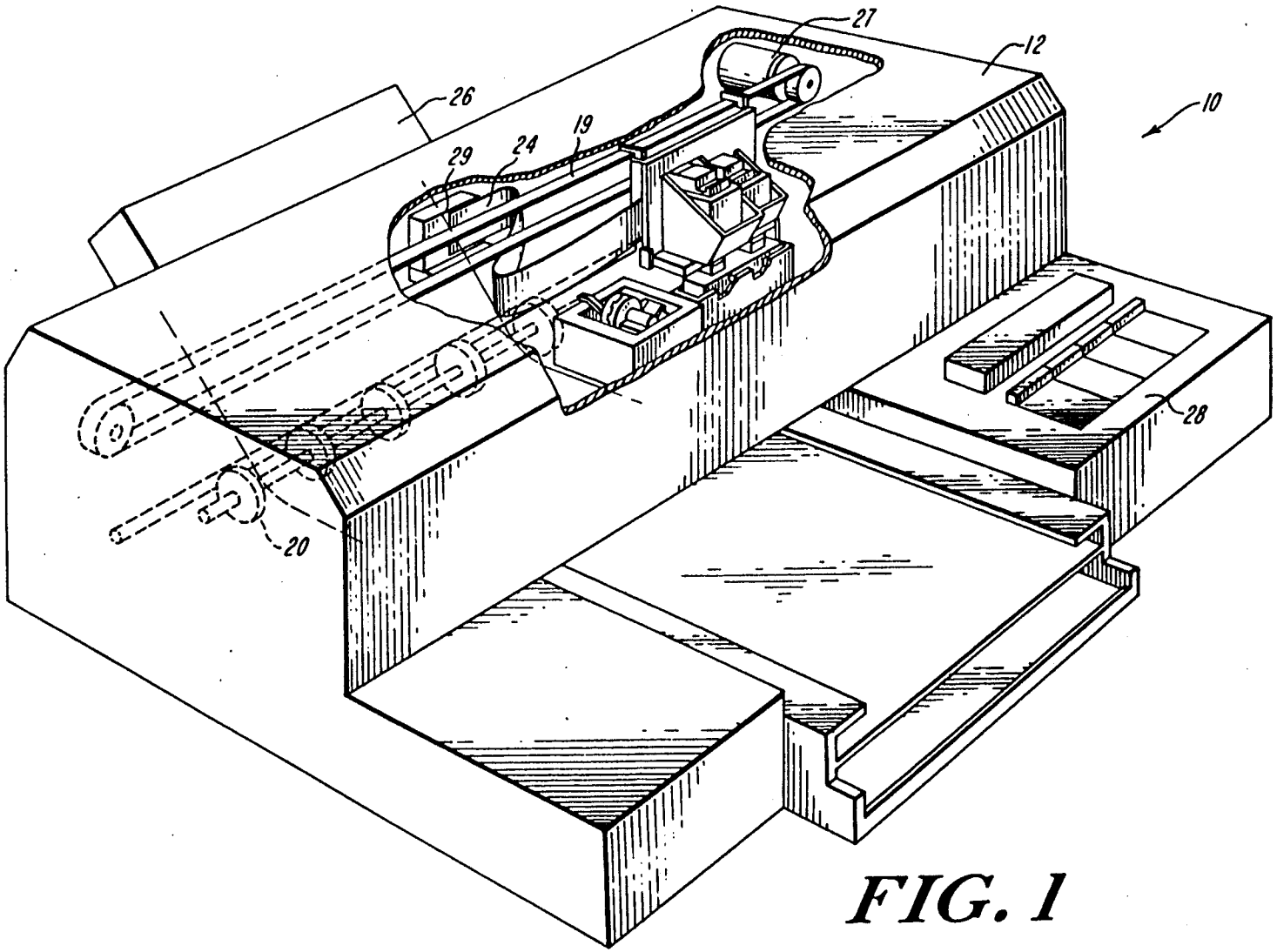
FIG. 1 is a perspective view of an ink-jet printer containing the wiper of this invention.

With reference now to the drawings, and more particularly to FIG. 1 thereof, a typical ink-jet printer 10 will be described with which the wiper of this invention may be used. Ink-jet printer 10, as shown in the drawings, is of the type in which printing is done in a substantially horizontal plane. However, it is to be understood that the wiper of this invention is shown used in conjunction with this type of printer for purposes of illustration only and that the wiper of this invention can be used with other types of ink-jet printers in which printing is not done in a substantially horizontal plane and which have different configurations.

Ink-jet printer 10 includes a housing 12, a printhead carriage 14, a carriage guide 16, a carriage rod 18, drive roller assembly 20, platen 22, paper supply 26, and service station 36. Drive roller assembly 20 feeds paper, or another print medium, supplied to it by paper supply 26 to a printing zone disposed between print head carriage 14 and platen 22 in a manner well known to those skilled in the art. Printhead carriage 14 travels back and forth on carriage rod 18 and carriage guide 16 through the printing zone. Printhead carriage 14 is moved bi-directionally typically by means of a belt 19 connected to a carriage motor 27. Printhead carriage 14 includes print cartridges 30 and 32 which are connected by a flexible electrical interconnect strip 24 to a microprocessor 29. Microprocessor 29 also controls carriage motor 27. A control panel 28 is electrically associated with microprocessor 29 for selection of various options relating to the printing operation. Such control operations, provided by presently available microprocessors, are well known in the prior art and form no part of this invention.

Print cartridges 30 and 32 are held in locked alignment in printhead carriage 14 by carriage chutes 21 and 23, respectively. Cartridges 30 and 32 each have an associated printhead 31 and 33 respectively, provided on a bottom surface thereof. Printheads 31 and 33 could each print with either black ink or with a variety of colored inks. For purposes of the illustrative embodiment described in this application, printhead 31 is a color printhead which employs three sets of nozzles, each of which set expels a different primitive color, while printhead 33 utilizes only black ink. However, it is to be understood that printheads 31 and 33 could both use black ink or both use colored ink or printhead 33 could use colored inks and printhead 31 could use only black ink. Furthermore, any number of different colored inks could be used by any of the printheads, as desired. Typically, printheads 31 and 33 are thermal ink-jet printheads. However, printer 10 could operate with other ink-jet printheads, if the carriage interfaces are compatible, or with other carriage configurations. Furthermore, reconfiguration of cartridges 30 and 32 would permit use of other ink-jet technologies, such as piezoelectric printheads.

Printheads 31 and 33 each typically comprise a plurality of resistors (not shown) associated with a plurality of nozzles (not shown) formed in a nozzle plate 37 and 39, respectively. Nozzle plate 37 of color printhead 31 contains three separate sets of plural nozzles, one for each color printed by the printhead. Ink is stored in reservoirs (not shown) within cartridges 30 and 32. Printhead cartridges 30 and 32 and printheads 31 and 33, respectively, operate in a manner well known to those skilled in the art.

Figure 2:
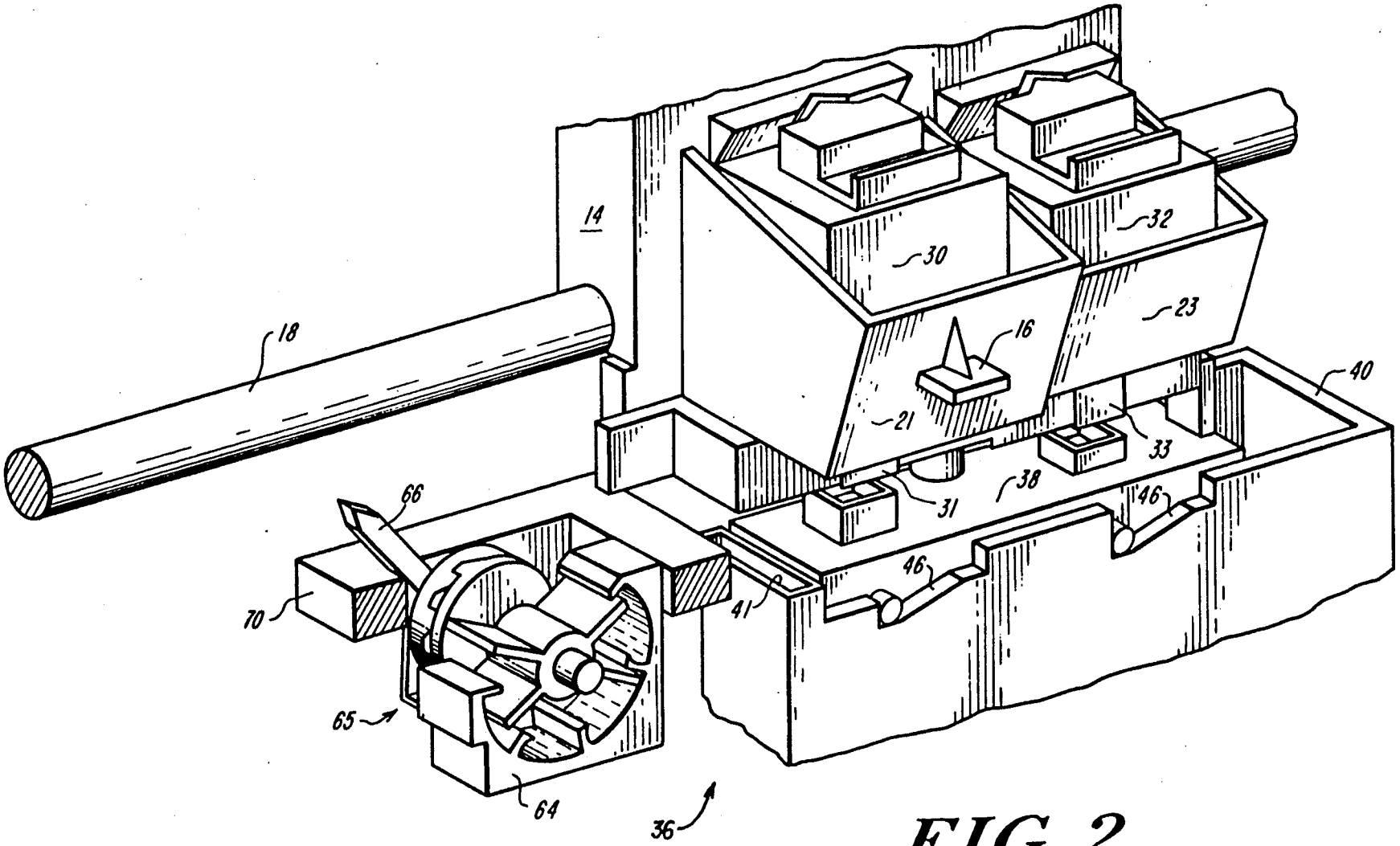
FIG. 2 is a partial, isometric view of the service station area of the printer of FIG. 1.

An assembled service station 36 which includes the wiper of this invention is depicted in FIG. 2. Service station 36 is a region at one end of the bi directional movement of carriage 14. Service station 36 includes a wiper mechanism designated generally as 65. In the exemplary printer 10 with which this invention is being described, service station 36 also may include a sled 38, a sled support 40 and a spittoon 41. However, the sled 38 forms no part of this invention and is not required for its operation. Typically, wiper mechanism 65 is disposed in service station 36 on a side of sled 38 facing the center of printer 10 so that printheads 31 and 33 may selectively move across mechanism 65 and so that printheads 31 and 33 may be capped after wiping.

Bosses 44 disposed on the sides of sled 38 rest on ramps 46 of sled support 40. Sled 38 is moveable along ramps 46 of sled support 40 from left to right and right to left as shown in FIG. 2. Bosses 44 ride up along associated ramps 46 as the sled moves from left to right as shown in FIG. 2, from a lower portion 48 to an upper portion 50, and visa versa. As sled 38 is in its most left hand position, as shown in FIG. 2, bosses 44 reside in lower portion 48, while when sled 38 is in its most right-hand position (not shown), bosses 44 reside in upper portion 50 of ramp 46. Sled 38 includes an upwardly extending projection 52 which is engaged by a surface of carriage 14, typically a front tab 54, as it moves over sled 38. As front tab 54 strikes projection 52, caps 51 and 53 on sled 38 are automatically aligned with printheads 31 and 33, respectively. Further movement to the right of carriage 14 causes sled 38 to rise upwardly on ramps 46 and causes caps 51 and 53 to be pressed against the perimeter of the orifice plates 37 and 39 of printheads 31 and 33 for sealing thereof. Also, as sled 38 rises upwardly on ramps 46, projection 57 enters into a tapered slot 58 intermediate printheads 31 and 33. Thus, when carriage 14 subsequently leaves service station 36, projection 57 ensures that the sled 38 is returned to its inactive, lower position as shown in FIG. 2, in which bosses 44 reside in lower portion 48 of ramp 46. Projection 57 drops out of slot 58 as sled 38 is lowered to its inactive position. The purpose of the ramped sled motion is to prevent wear on caps 51 and 53 and to prevent sliding of the caps over the nozzle plates which may cause debris from the cap lips to contact the nozzle plates.

Spittoon 41 is an open chamber which may be integrally formed with sled support 40, as indicated in FIG. 2. Spittoon 41 retains ink ejected or spit from printheads 31 and 33 during the wiping process, as explained hereinafter.

The wiper mechanism of this invention comprises at least the same number of blades as there are printheads. In the exemplary embodiment described herein, there are two wiping blades, one for each printhead 31 and 33 so that there is no contamination of one printhead with ink from the other. The wiping is produced by printhead carriage 14 dragging each printhead across its associated wiper blade while the blade is stationary. Thereafter, the blade is indexed for cleaning thereof and for bringing a fresh blade surface into wiping contact with a printhead. Ink may be expelled from printheads 31 and 33 before or during wiping to rehydrate dried ink disposed on the printhead to facilitate its removal by the wiping blades.

Figure 3:
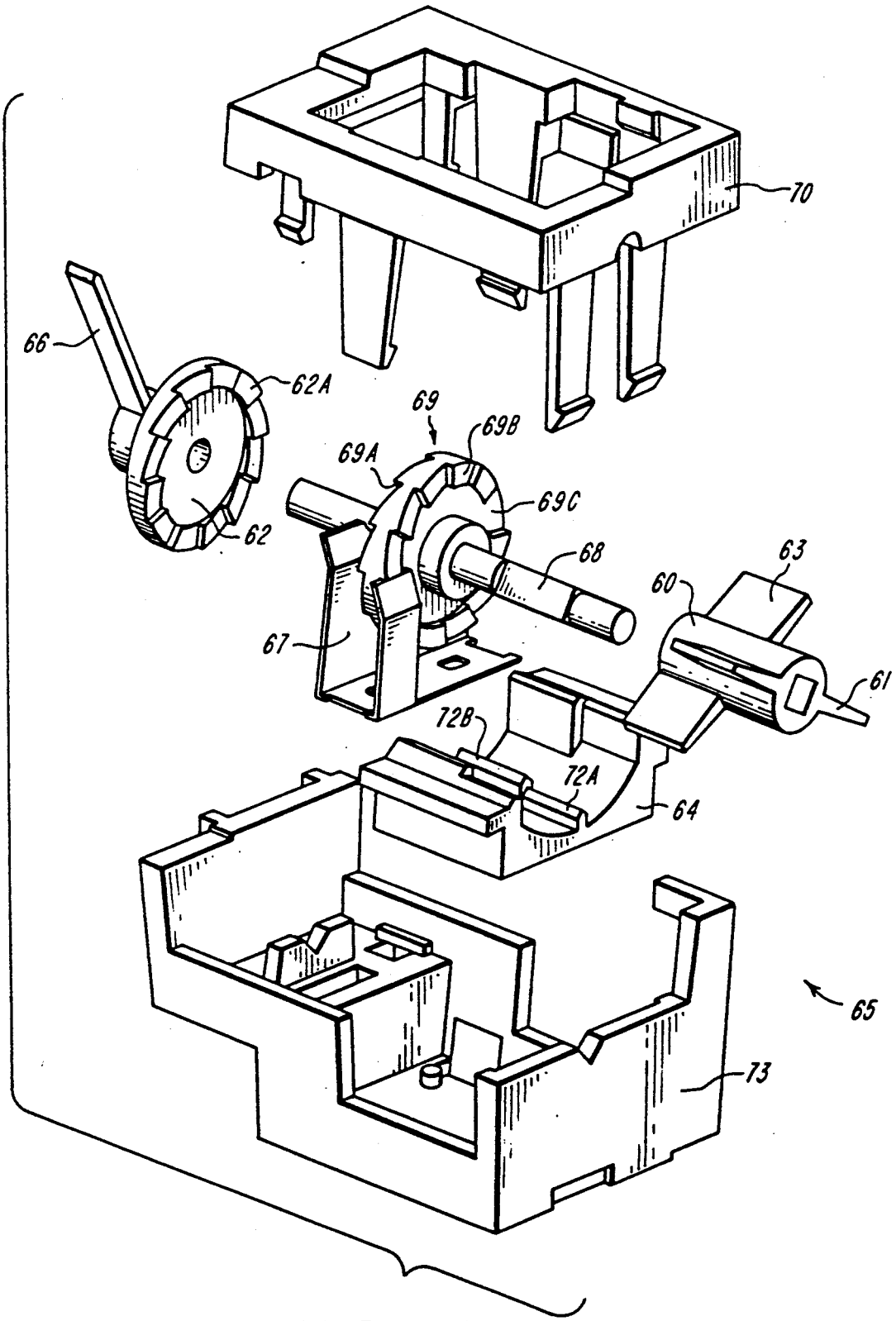
FIG. 3 is an exploded perspective view of the elements of the wiper of this invention.

A first embodiment of a wiper mechanism embodying this invention will now be described with particular reference to FIGS. 2–12. As shown in FIG. 3, wiper mechanism 65 comprises wiper 60, having at least two blades 61 and 63, ratchet 62, arm 66, leaf spring 67, central shaft 68, pawl wheel 69, base 73, and housing 70.

In the printer 10 of the first illustrative embodiment of this invention, color printhead 31 is offset on printhead carriage 14 with respect to block printhead 33, so that printhead 31 is spaced farther from the paper and closer to the front of printer 10 than is printhead 33. The typical orifice plate to paper spacing for printhead 31 is 85/1000ths of an inch while the typical orifice plate to paper spacing for printhead 33 is 52/1000ths of an inch. The positioning of printheads 31 and 33 at different levels and different axial positions with regard to the axis of rotation of wiper 60 allows each printhead to be cleaned by a designated wiper blade, as explained hereinafter, and avoids cross-contamination or mixing of color and black ink on the printhead surfaces.

Wiper 60 has a generally cylindrically shaped body with a central bore through which shaft 68 passes. Wiper 60 includes blades 61 and 63 which extend radially from a central axis coincident with shaft 68. Blades 61 and 63 each have distal tips 61D and 63D, respectively, which serve to wipe the nozzle plates of the printheads. Blade 61 has a slightly greater length than blade 63. Typically the difference between the lengths of blades 61 and 63 is about equal to the difference between the printhead to paper spacing for printhead 31 and that for printhead 33. In the typical example provided herein, this difference is about 33/1000ths inch. When properly indexed, as explained hereinafter, the longer of the two blades, blade 61, is used to wipe color printhead 31, which is recessed slightly, while the shorter blade, blade 63, is used to clean black printhead 33.

In the preferred embodiment, shaft 68 has axial length of approximately 13 mm. Blades 61 and 63 each have a width of approximately 7 mm, and are axially offset along shaft 68 so that there is an overlap of approximately 1 mm.

In an alternate embodiment, blades 61 and 63 of wiper 60 may be axially aligned along shaft 68 provided printheads 31 and 33 ar also axially aligned with respect to the axis of rotation of wiper 60.

Wiper 60 is preferably formed of a resilient material such as a synthetic rubber or the like, so that as a printhead passes over its corresponding wiper blade, the blade flexes to accommodate the irregular surface of the printhead and then returns to its original configuration without substantial deformation. A material suitable for use as wiper 60 is Ethylene Propylene Diene Monomer (EPDM) or nitrile rubber. A horizontal oscillating motion of a printhead over its respective wiper blade provides a firm aggressive wiping action along the distal tip of the blade which is preferred for satisfactory removal of dust, ink or other contaminants from the printhead. In the preferred embodiment, wiper 60 has four blades, oriented radially in an alternating pattern. Blades 61 and 61A wipe printhead 31 and blades 63 and 63A wipe printhead 33. Typically, the angular spacing between blades 61 and 63 and blades 61A and 63A is 120°, while the angular spacing between blades 63 and 61A and blades 61 and 63A is 60°. However, other numbers of blades and other spacings may be used, as desired.

The central bore of wiper 60 is disposed about central shaft 68. Shaft 68 preferably has a rectangular cross-sectional configuration in the vicinity of wiper 60 to provide a secure interlock between shaft 68 and wiper 60. Shaft 68 is rounded at its ends where it is journaled in cooperatively formed slots in housing 70 and base 73. Shaft 68 is coupled to pawl wheel 69 which comprises a circular disk 69 having a plurality of inclined teeth, 69A and 69B, extending perpendicularly from each surface thereof. Pawl wheel 69 is movably coupled to ratchet 62. Ratchet 62 is comprised of a circular disk having a plurality of inclined teeth 62A, similar to those of pawl wheel 69, extending perpendicularly from one surface thereof. Ratchet 62 is disposed about shaft 68. The adjacent surfaces of pawl wheel 69 and ratchet 62 which contain the inclined teeth, are engage in a complimentary mating manner. Leaf spring 67 is secured to base 73 and biases pawl wheel 69 and ratchet 62 together in an interlocking relationship so that wheel 69 and ratchet 62 rotate together in one direction, e.g. a clockwise direction. Wheel 69 is coupled to wiper 60 via shaft 68 and produces rotation of wiper 60 as it rotates. Wheel 69 and wiper 60 are prevented from rotating in a second direction, e.g., a counter clockwise direction, by inclined teeth 69B which engage leaf spring 67 to provide a ratcheting effect in a manner well known to those skilled in the art. Leaf spring 67 flexes in a direction parallel to the axis of shaft 68 to permit movement of ratchet 62 in a direction opposite of the one direction with respect to ratchet 62, i.e., in a clockwise or counterclockwise direction.

Arm 66, which is preferably comprised of a stiff, but resilient material such as plastic, is mounted to ratchet 62. When arm 66 is displaced, preferably with a rightward moving force applied to its distal end, inclined teeth 62A of ratchet 62 engage inclined teeth 69A of pawl wheel 69 causing a rotation of shaft 68 and wiper 60 in a clockwise direction. As shaft 68 rotates, blades 63 and 61 of wiper 60 are rotated or indexed. When a leftward moving force is applied to the distal tip of arm 66, leaf spring 77 flexes to allow ratchet 62 to move in a counterclockwise direction over the surface of pawl wheel 69 allowing arm 66 to return to its initial position. Simultaneously, one of the inclined teeth 69B engages leaf spring 67 preventing pawl wheel 69 and shaft 68 from rotating, maintaining wiper 60 in its present status. In this manner, wiper blades 61 and 63 may be indexed in a clockwise direction by the application of both rightwardly and leftwardly moving forces to arm 66 of wiper mechanism 65.

Leaf spring 67 and cleaning apparatus 64 are secured to wiper base 73. Shaft 68 is movably secured to base 73 so that ratchet 62 and pawl wheel 69 are disposed in leaf spring 67 while wiper 60 is disposed within cleaning apparatus 64. Wiper housing 70 is secured to base 73 in an interlocking manner. Wiper housing 70 and base 73 collectively enclose all elements of wiper mechanism 65 except for the distal end of arm 66 and the blades of wiper 60 which extend through an irregular shaped aperture in the top surface of housing 70.

Cleaning apparatus 64 encloses the portion of wiper 60 spaced from the area in which wiping of the printheads occur. Blades 61, 61A, 63 and 63A each pass through apparatus 64 after wiping of the printheads as wiper 60 is indexed. In a preferred embodiment, cleaning apparatus 64 comprises at least one and preferably a plurality of scrapers 72 disposed in an arcuate orientation around the perimeter of the wiper 60 as defined by the tips of blades 61, 61A, 63 and 63A. Typically, scrapers 72 are disposed extending toward wiper 60 from the interior surface of an arcuate cavity surrounding that portion of wiper 60 spaced from the area where the wiping function is performed. Scrapers 72 each comprise a bilevel rigid blade having edges 72A and 72B that may face inwardly toward shaft 68, as shown in FIG. 3. Edge 72A rides along a portion of each blade 61 and 61A, that passes thereover to perform the desired scraping action. Similarly, edge 72B rides along a portion of each blade 63 and 63A that passes thereover. Edge 72A of each scraper is disposed closer to the interior surface of the arcuate cavity of cleaning apparatus 64, as shown in FIG. 3, to accommodate blades 61 and 61A which have a greater length. Scrapers 72 are rigidly mounted onto apparatus 64 so that they do not move or flex as blades 61 and 63 pass thereover. Edges may or may not be sharpened. Scrapers 72 may each have an orientation generally parallel to blades 61 and 63 and to a radius of shaft 68 or may have a non radial alignment. Any circumferential spacing of scrapers 72 is acceptable, so long as the tips of blades 61 and 63 are dragged across edges 72A and 72B, respectively, of the scraper 72 during rotation of wiper 60. Scrapers 72 are preferrably spaced inwardly from the tips of blades and nd 63 toward shaft 68 so that edges 72A–B scrape along the lateral surfaces of the blades and flex while passing thereover. This flexing of the blade produces a "flicking" action, as the blade tips return to their original configuration which also helps propel contaminants off the blades. Scrapers 72 may be disposed around the entire perimeter of the cavity in cleaning apparatus 64 except for the area above wiper housing 70.

When more than one scraper 72 is provided, each blade 61, 61A, 63 and 63A is scraped a number of times before it again cleans its respective printhead providing multiple opportunities for removal of contaminants. The number of scrapers 72, the length thereof, as well as their orientation is not critical, so long as the desired scraping action is provided.

It will be obvious that for an embodiment of wiper 60 having blades 61 and 63 which are not axially displaced with respect to shaft 68 as shown in FIGS. 1–2, 4–10, each scraper 72 of cleaning apparatus 64 may have a single edge which scrapes all wiper blades, instead of a bilevel edge scraper in which each edge 72A and 72B scrapes only selected blades.

Ink and contaminants which are removed from wiper 60 by scrapers 72 tend to move under the influence of gravity and as a result of the flicking action of blades 61 and 63, down the lateral surfaces of scrapers 72 and away from edges 72A–B. The ink tends to carry solid contaminants with it. Thus, scrapers 72 are self cleaning, and need only be cleaned when solid contaminants have built up to an undesirably high level.

Wiper 60 and the blades thereof are indexed as follows. A tab at the base of arm 66 contacts a surface in base 73 to limit rotary movement of arm 66 from an initial position left of vertical, e.g. 30°, to final position right of vertical, e.g. 30°. When arm 66 rotates through a displacement, e.g. 60°, ratchet 62 and pawl wheel 69 rotate in unison because leaf spring 67 urges them together and insures that the perpendicular surfaces of tooth 62B is adjacent the perpendicular surface of tooth 69B. Central shaft 68, which is coupled to pawl wheel 69, causes a corresponding 60° rotation of wiper 60 and a 60° angular displacement of blades 61 and 63. When the force is removed, and a leftwardly force applied, arm 66 is urged to its initial position at 30° left of vertical. As arm 66 rotates to its initial position, the inclined surface of tooth 62A rides along inclined surface of one of teeth 69A causing ratchet 69 and pawl wheel 69 to separate in an axial direction against the force of spring 67 until teeth 69A moves circumferentially into the next adjacent cooperatively formed slot. This process is repeated until arm 66 strikes a surface of base 73. Pawl wheel 69 is retained in its current position by leaf spring 67 which is disposed adjacent the vertical surface of tooth 69A thereby preventing rotation of wheel 69, shaft 68 and wiper 60. In this manner, successive displacements of arm 66 by alternating rightwardly and leftwardly moving force cause indexing or rotation of wiper 60 so that the blades 61 and 63 are displaced accordingly. By setting the initial position of wiper 60, precise positioning of blades 61 and 63 may be achieved.

The rotation of blade 61 and 63 of wiper 60 in a clockwise direction through cleaning apparatus 64 provides an automatic cleansing of the blade tips following wiping of the printheads to prevent recontamination of the printheads and to reduce the servicing requirements for wiper 60.

Figure 4:
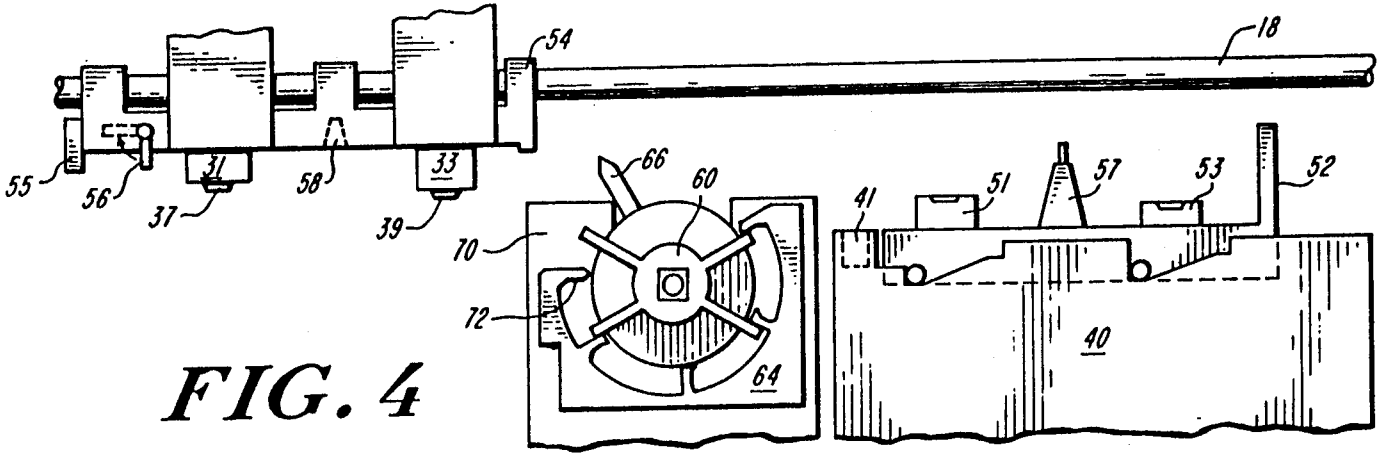
FIG. 4 is a front, plan view of the service station area of FIG. 2 showing the printhead carriage approaching the service station.

The interaction of wiper 60 with printhead carriage 14 to achieve wiping of printheads 31 and 33 in the preferred embodiment will be described with reference to FIGS. 4–12. Referring to FIG. 4, printhead carriage 14, which is preferably belt driven, advances along carriage rod 18 with a rightwardly motion towards service station 36. Sled 38 is disposed in sled support 40 at the lower portion of 48 of ramp 46. Wiper 60 is disposed within wiper housing 70 so that the "dead zone", the 120° area separating blades 61 and 63, faces upwardly, with blades 61 and 63 displaced 60° to the left and right, respectively, of vertical. Arm 66 is disposed 30° left of the vertical, resting against wiper housing 70, as shown. It should be noted that rear tab 55 and flapper 56 of printhead carriage 14 as well as arm 66 of wiper mechanism 65 are offset behind printheads 31 and 33 and wiper 60.

Figure 5:
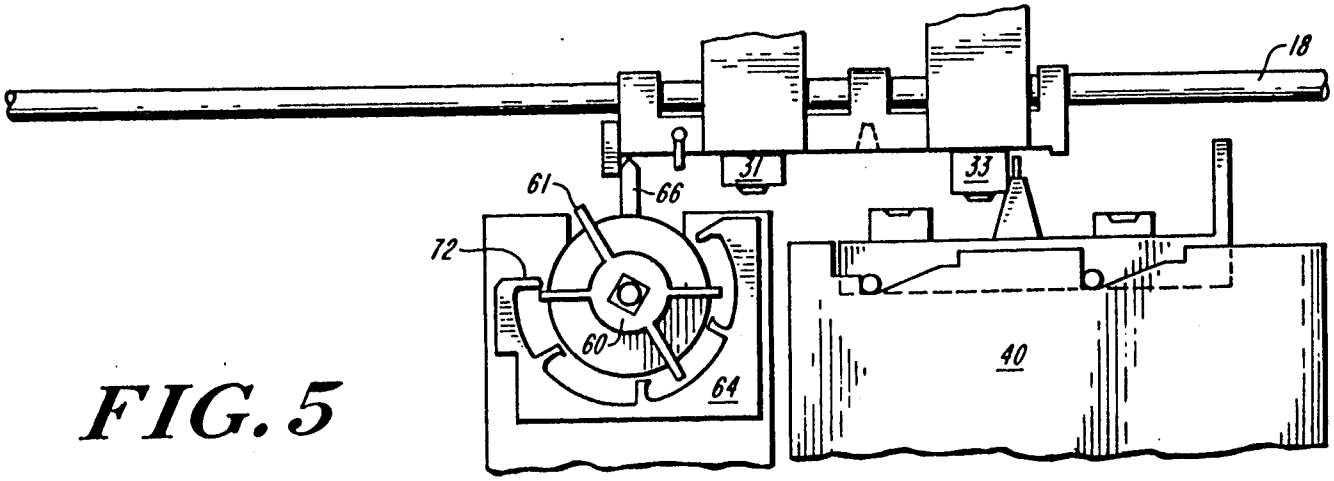
FIG. 5 is a front, plan view of the service station of FIG. 2 showing the printhead carriage engaging and rotating the arm of the wiper mechanism.
Figure 6:
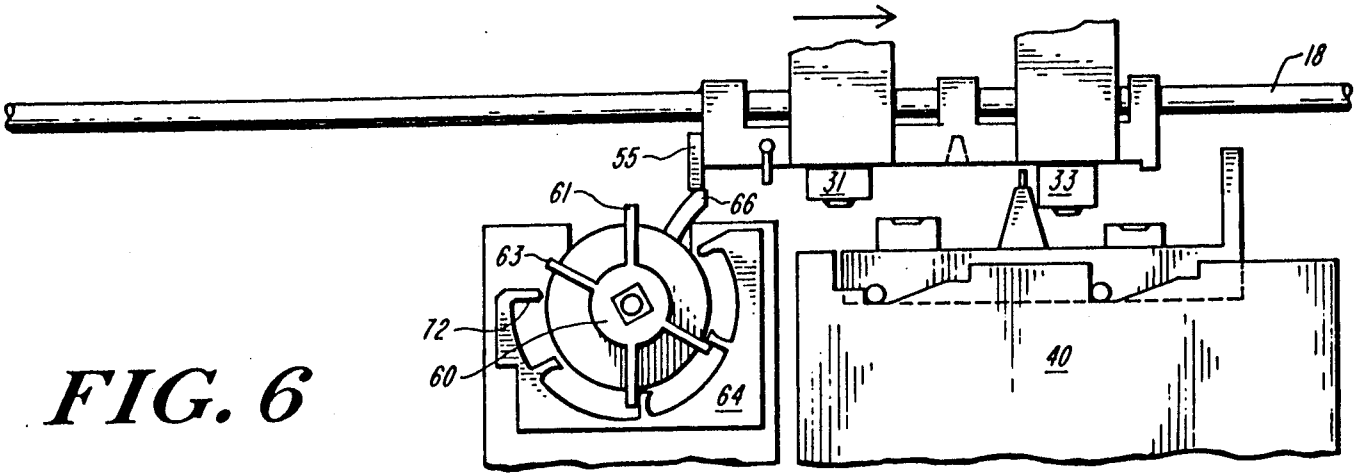
FIG. 6 is a front, plan view of the service station of FIG. 2 showing the wiper arm at its final position of rotation.
Figure 7:
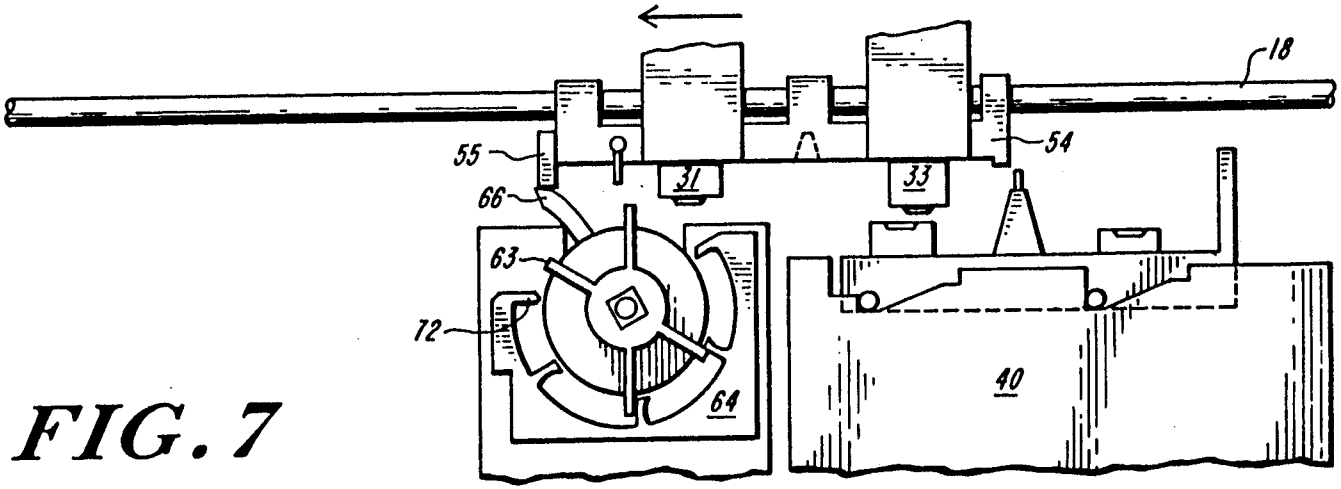
FIG. 7 is a front, plan view of the service station of FIG. 2 showing the printhead carriage engaging and rotating the wiper arm back to its initial position.
Figure 8:
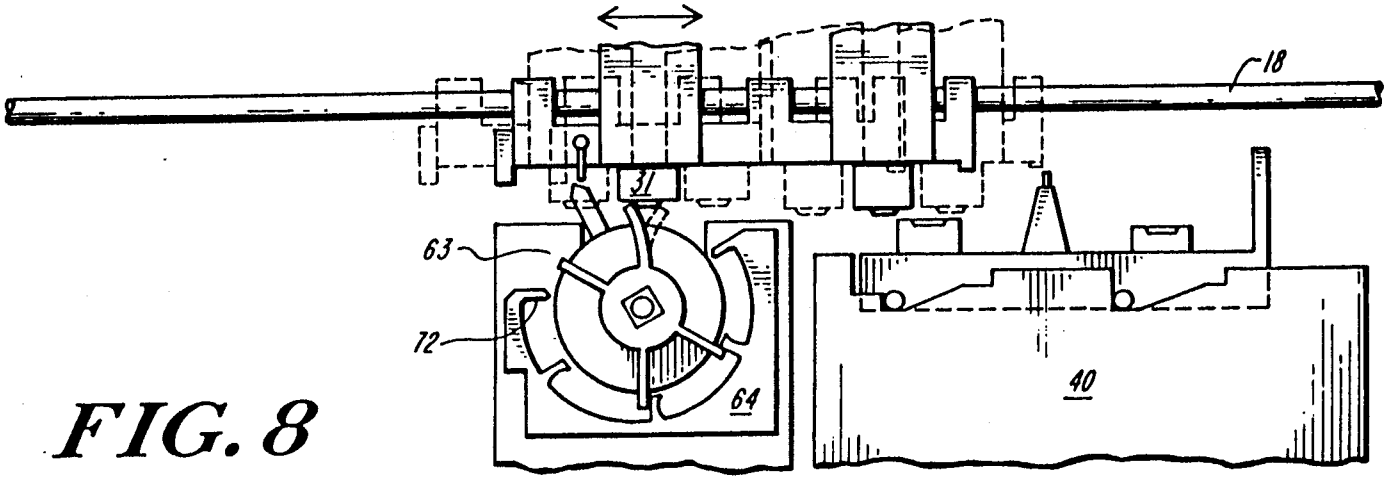
FIG. 8 is a front, plan view of the service station of FIG. 2 showing the color pen of the printhead carriage in contact with the wiper, with the positions of the printhead carriage necessary to achieve the wiping action shown in phantom
Figure 9:
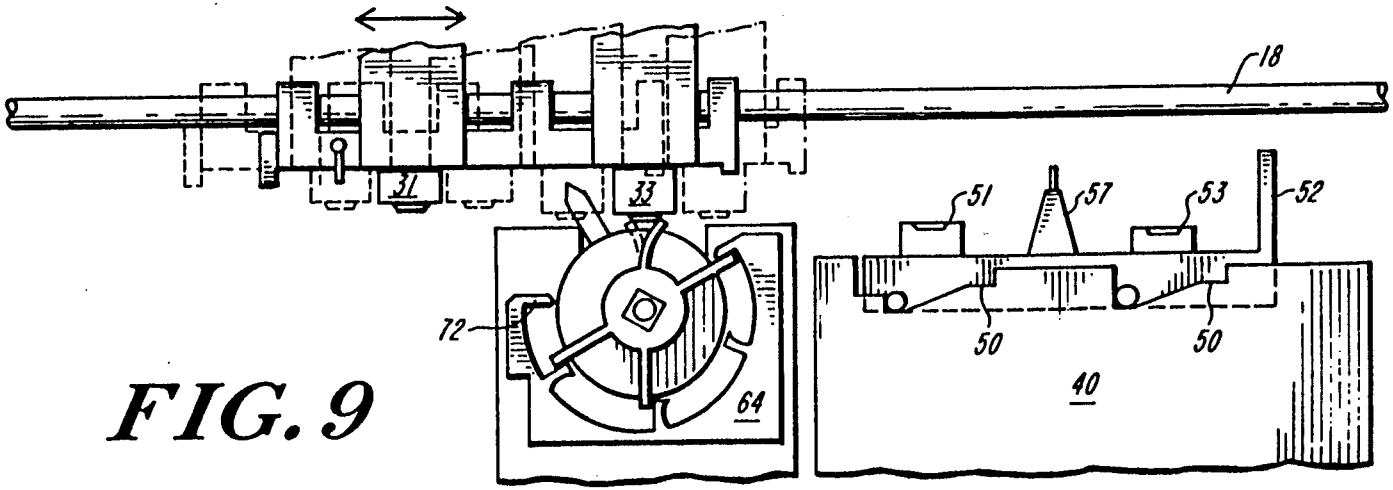
FIG. 9 is a front, plan view of the service station of FIG. 2 showing the black pen of the printhead carriage in contact with the wiper, with the positions of the printhead carriage necessary to achieve the wiping action shown in phantom.

As printhead carriage 14 continues in a rightwardly direction towards service station 36, flapper 56, which is pivotally mounted to printhead carriage 14, contacts arm 66 and is pivoted from its initial vertical position to a position 45° left of vertical to allow passage of arm 66 thereunder. As printhead carriage 14 continues rightwardly, rear tab 55 engages arm 66 causing it to rotate in a continuous manner to a position 30° right of the vertical, as shown sequentially in FIGS. 5 and 6. Rotation of arm 66 causes a similar rotation of blade 61 from 60° left of vertical to vertical, as shown in FIG. 5. As printhead carriage 14 continues rightwardly, arm 66, which is position 30° right of vertical, flexes to allow passage of rear tab 55 thereover, as shown in FIG. 6. Printhead carriage 14 then stops, and changes directions, moving leftwardly. As printhead carriage 14 continues leftwardly, rear tab 55 again engages arm 66 causing it to rotate in a continuous manner from its current position, 30° right of vertical, to its initial position, 30° left of vertical. As printhead carriage 14 continues leftwardly, arm 66 again flexes to allow passage of rear tab 55 and flapper 56 thereover, as shown in FIG. 7.

Leaf spring 67 engages teeth 63 of pawl wheel 69 preventing wiper 60 from rotating back to its initial position and retaining blade 61 in a vertical position, projecting from housing 70.

With the distal tip of arm 66 disposed to the right of tab 55 and flapper 56, printhead carriage 14 next moves rightwardly to bring the nozzle plate 37 of color printhead 31 into contact with the distal tip of blade 61. Printhead carriage 14 then moves back and forth in an oscillating manner, causing nozzle plate 37 to be repeatedly drawn back and forth across the distal tip of blade 61, thereby wiping nozzle plate 37 clean of contaminants. The various positions assumed by printhead carriage 14, printhead 31 and blade 61 are shown in phantom in FIG. 8. In a preferred embodiment, printhead 31 is oscillated back and forth across blade 61 approximately three times to achieve adequate wiping of the nozzle plate. The algorithm cf computer instructions which enables microprocessor 29 to drive printhead carriage 14 in an oscillating manner is well within the scope of those reasonably skilled in the data processing art Such an algorithm simply manipulates the position of printhead carriage 14 along the axis parallel carriage rod 18 to create an oscillating of printhead 31.

After printhead carriage 14 has moved across blade 61 the desired number of times, the printhead carriage moves rightwardly along carriage rod 18 so that rear tab 55 again engages arm 66 of wiper mechanism 65 causing a 60° rotation of arm 66 and a corresponding rotation of wiper 60, as explained previously. Blade 63, which was positioned 60° left of vertical during the wiping of color printhead 31 is now disposed vertically. The printhead carriage 14 then changes direction, moving leftwardly so that rear tab 55 again engages arm 66 causing it to rotate in a continuous manner, as previously described, to its initial position at 30° left of vertical.

The wiping of black printhead 33 by blade 63 is achieved in a similar manner as that previously described with regard to printhead 31 and blade 61. With the distal tip of arm 66 disposed to the right of tab 55 and flapper 56, printhead carriage 14 moves rightwardly until nozzle plate 39 of printhead 33 is in contact with the distal tip of blade 63. Blade 63 remains stationary while nozzle plate 39 is moved back and forth in an oscillating manner over the tip of blade 63, as previously described with regard to the wiping of printhead 31. The various positions which printhead carriage 14, printhead 33 and blade 63 assume during this process are shown in phantom in FIG. 9. Preferably, printhead 33 is moved across blade 63 three times to achieve adequate removal of contaminants from the nozzle plate 39.

The same computer algorithm used to manipulate the position of printhead carriage 14 during the wiping of printhead 31 may be used to oscillate the position of printhead carriage 14 during the wiping of printhead 33, as would be obvious to one reasonably skilled in the art.

The number of wiping passes required to adequately clean printheads 31 and 33 is a function of the viscosity of the ink, the type of solid contaminants to be removed, and the rate of build-up of contaminants. More passes of the wiper blades over the printhead nozzle plate may be required for high viscosity inks, for finer and more gritty solid contaminants and for a faster build-up. The moistening of the wiper blades during the wiping process facilitates softening of encrusted ink deposits.

Figure 10:
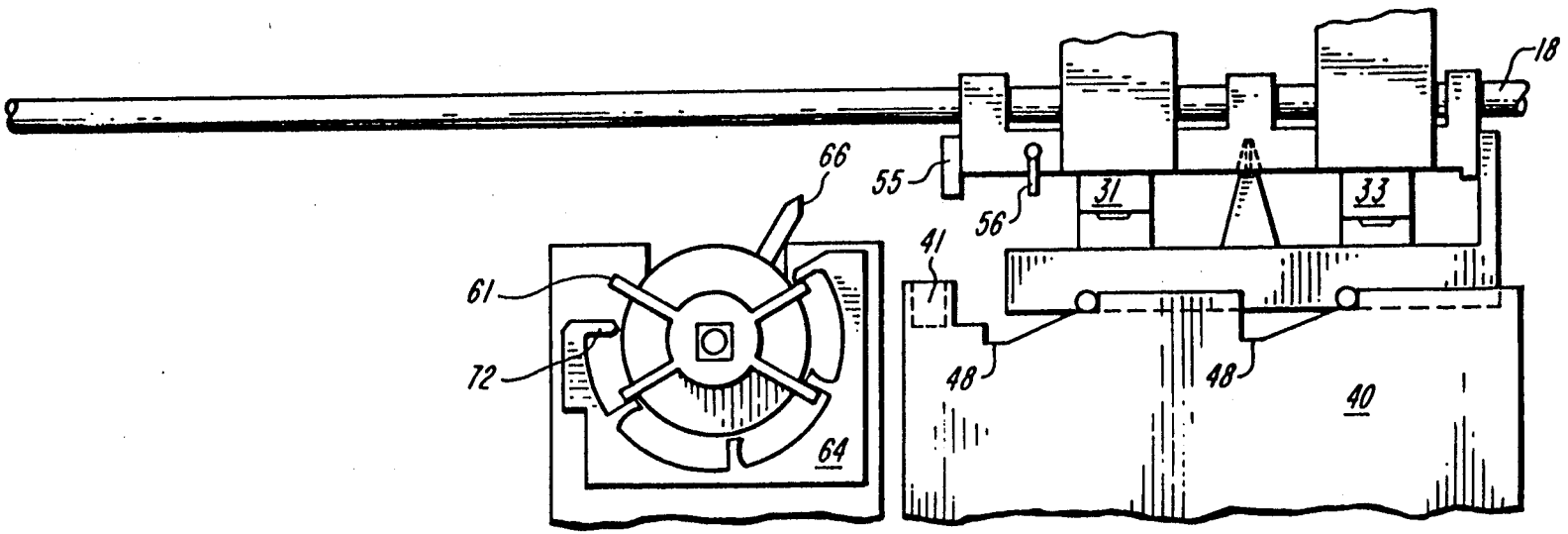
FIG. 10 is a front, plan view of the service station of FIG. 2 showing the printhead carriage in a capped position and the wiper mechanism in a neutral position.

Once printhead 33 has moved across blade 63 the desired number of times, printhead carriage 14 moves rightwardly towards service station 36. Rear tab 55 engages arm 66, again causing a rotation of arm 66 and corresponding rotation of wiper 60, as previously described. This rotation of wiper 60 causes blade 63 to be rotated from vertical to 60° right of vertical causing another "dead zone" of wiper 60, between blades 61A and 63A, to be facing upward as shown in FIG. 10. As printhead carriage 14 travels into the service station 36, front tab 54 engages projection 52 of sled 38 with a rightwardly force. As projection 52 is moved to the right, bosses 44 are drawn from the lower level 48 of ramp 46 to the upper level 50 of ramp 46, coming to rest at the top of sled support 40. Simultaneously, projection 57 enters tapered slot 58 and caps 51 and 53 are pressed against the perimeter of nozzle plates 37 and 39, respectively, for sealing thereof. Printhead carriage 14 remains in the service station 36 while inactive as shown in FIG. 11.

When printhead carriage 14 subsequently leaves service station 36, the leftwardly motion of the printhead carriage moves projection 57, and thus sled 38 leftwardly. Projection 57 withdraws from slot 58, as sled 38 returns to its inactive, lower position, in which bosses 44 reside in lower portion of ramp 46. As printhead carriage 14 moves leftwardly, rear tab 55 engages arm 66 causing it to rotate in a continuous manner to its initial position and 30° left of vertical, as previously described. Due to its resilient nature, arm 66 flexes to allow the passage of rear tab 55 and flapper 56 thereover. Since wiper 60 is positioned with a "dead zone", printheads 31 and 33 pass over wiper assembly 65 without contact. Printhead carriage 14 may then continues with its printing functions.

The wiping operations described above may be programmed to automatically occur at the beginning or end of each page, as desired. Such instructional routines may be encoded into firmware which controls the printer operations and is well within the scope of one reasonably skilled in the firmware development arts. For proper execution of the above described wiping sequences wiper 60 must be initially disposed in the "dead zone" position. To insure that wiper 60 is in the dead zone position upon initialization or reset of printer 10, printhead carriage 14 moves through a "homing" sequence. The homing sequence ensures that wiper 60 is in the dead zone position prior to initialization of a wiping sequence, even if printer 10 was accidentally powered down during a previous wiping sequence.

The homing sequence occurs as follows. Upon power-up or resetting of printer 10, printhead carriage 14 moves into the print zone to the left of service station 36. As printhead carriage 14 moves leftwardly, rear tab 55 encounters arm 66 and rotates it to its initial position, 30° left of vertical, if not already in that position at the time of powering or resetting of printer 10. Once in the print zone, printhead carriage 14 reverses directions, moving rightwardly so that flapper 56 contacts arm 66 and pivots thereover. As printhead carriage 14 continues rightwardly, rear tab 55 engages arm 66 and rotates it continuously from its initial position, 30° left of vertical to a vertical position. Printhead carriage 14 then reverses directions, moving leftwardly so that flapper 56 engages arm 66 and rotates it continuously from its vertical position back to its initial position at 30° left of vertical. This step of rotating arm 66, via tab 55, from its initial position to vertical, and from vertical back to its initial position, via flapper 56, is repeated six times by manipulating the position and direction of printhead carriage 14, accordingly.

Referring again to FIG. 3, inclined teeth 69B of pawl wheel 69 are arranged serially in groups of five teeth separated by flat surfaces 69C. When arm 66 is rotated clockwise through a displacement of 30°, ratchet 62 and pawl wheel 69 move in unison, as previously described, causing a corresponding 30° angular displacement of shaft 68 and wiper 60. Upon rotation of arm 66 in a counterclockwise direction, leaf spring 67 ratchets one of teeth 69B preventing rotation of shaft 68 and wiper 60, thereby maintaining the position of wiper blades 61 and 63, as previously described. However, when pawl wheel 69 is rotated counterclockwise so that leaf spring 67 encounters flat surface 69C, no ratcheting of wheel 69 occurs. Wiper 60, in this instance only, also rotates counterclockwise due to the inability of leaf spring 67 to engage flat surface 69C. Subsequent pairs of positive and negative 30° angular displacements result in no net displacement of wiper blade 60 from its current position. Shaft 68 and wiper 60 are coupled to pawl wheel 69 so that when leaf spring 67 encounters one of the two flat surfaces 69C the "dead zone" of wiper 60 is facing vertically.

If upon initiation of the homing sequence, leaf spring 67 is ratcheted against any tooth 69B other than the first of a five tooth series, pawl wheel 69 will be rotated clockwise over the remaining teeth 69B, and, upon leaf 67 encountering flat space 69C, will rotate in both a clockwise and counterclockwise direction for the remainder of the homing sequence. Once leaf spring 67 encounteres space 69C, subsequent pairs of positive and negative 30° angular displacements of arm 66 will result in no net displacement of wiper 60. If the homing sequence is initiated when leaf spring 67 is currently positioned at flat surface 69C, wiper 60 will rotate 30° clockwise, followed by a 30° counterclockwise rotation, for each of the six stages in the homing sequence. However, the total net angular displacement of wiper 60 during the homing sequence will be 0°. In this manner, regardless of the position of wiper 60 upon initializing or resetting printer 10, rear tab 55 and flapper 56 are used to ensure, that wiper 60 is disposed with the dead zone facing vertically, as required for proper wiping of printheads 31 and 33.

The homing sequence described above may be programmed to automatically occur upon initialization of printer 10 after power up or reset, as desired. Such instructional routines may be encoded into firmware which controls the printer operations and is well within the scope of one reaonsably skilled in the firmware development arts.

It may be appreciated from the above explanation that the present invention provides a wiping mechanism which allows a printhead carriage having both a color printhead and a black printhead to be freed of contaminants by a wiper mechanism which has a separate, self-cleaning blades for each printhead, to prevent recontamination of a printhead and to further prevent cross contamination between the different printheads.

The length of the wiper blades depends on the application, and manufacturing tolerances. For most applications, blades 61, 61A, 63 and 63A typically each are about 0.25" long, although it is to be understood that the provision of these exemplary dimensions does not serve in any way to limit the scope of the invention. Also, it will be recalled that blades 61 and 61A are longer than blades 63 and 63A, typically by a distance of approximately 0.033".

As previously mentioned, during the printing process, debris such as paper fibers and dust, as well as ink spray, accumulate on the nozzle plates of the printheads. This debris and ink can cause poor nozzle performance resulting in poor quality printing. In printers which contain color printheads, such as printer 10 of the illustrative embodiment, the accumulation of ink on color printhead 31 may cause mixing of ink or color contamination. The nozzle plate 37 of printhead 31 needs to be cleaned periodically to eliminate these contaminants. If the printhead is used in a high air flow or heated environment, the ink begins to dry and subsequent wiping of the nozzle plate with a dry wiper blade often is not sufficient to remove the contaminants from the nozzle plate.

According to another aspect of the present invention, the ink from a printhead itself is used to rehydrate the ink residue and contaminants adhered to the nozzle plate surface. Generally, the method of the present invention, referred to as a rehydrating scrub cycle, includes the steps of spitting ink from the printhead to be wiped onto a wiper blade. This ink may be spit either as the printhead is drawn across the blade tip at a slow speed prior to wiping, or as the printhead is actually being wiped. The printhead is drawn across the wet blade at various speeds to remove ink and other debris in the manner previously described. This aspect of the invention typically is used only when initiated by the operator when the print quality has been observed to fall below an acceptable level. It is not generally routinely initiated at the beginning or end of each page of print.

The preferred rehydrating scrub cycle described below is for illustrative purposes only and is not meant to limit the scope of the present invention. While the rehydrating scrub cycle of the present invention utilizes the interaction of the printer operator, it will be obvious to those reasonably skilled in the art that this method may be actuated and executed under control of a computer or microprocessor at periodic intervals. The instructional routine necessary for such an automated execution is within the scope of those reasonably skilled in the art and will not be explained in detail here.

Figure 11A:
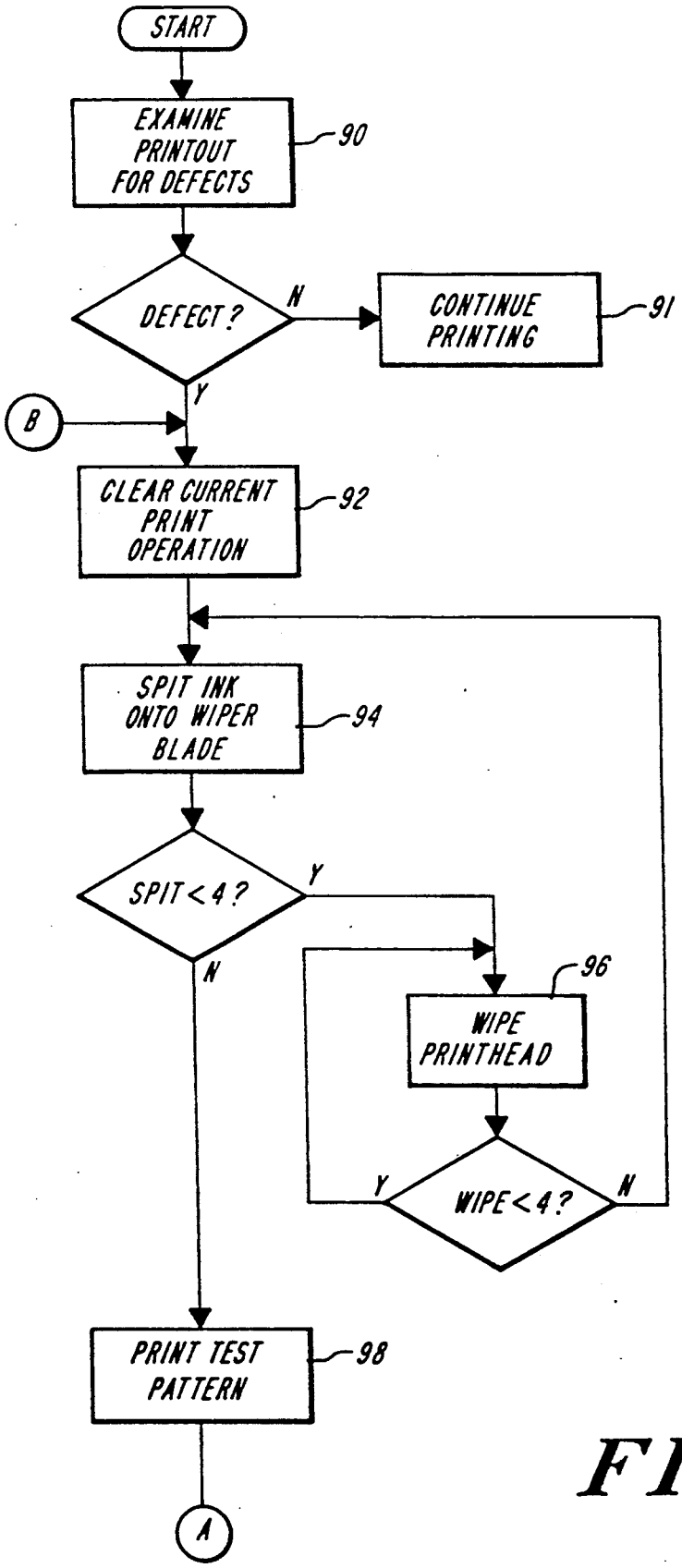
FIG. 11A is a flow chart of the first two phases of the rehydration scrubbing cycle of the present invention.

Referring to FIG. 11A, a flow chart of the steps comprising the rehydrating scrub cycle of the present invention is illustrated. The operator of ink-jet printer 1 visually checks the printer output for defects in the printing quality of the printheads, as indicated by step 90 of FIG. 11A. If no print errors exist, normal operation of printer 10 continues, as indicated by step 91. If the print quality degrades below an acceptable level, or if a visually detectable defect exists, the operator stops the current print operation, as indicated by step 92. The stopping of the current operation or clearing of the printhead typically occurs by depressing a clear button on control panel 28 of printer 10. Such control operations, provided by presently available microprocessors, are well known in the prior art and form no part of this invention.

The initial phase of the rehydrating scrub cycle begins with printhead 31 moving across the distal tip of blade 61 at a slow rate, preferably 1 inch per second, after blade 61 has been indexed into a vertical position, as previously described. As the tip of blade 61 approaches the nozzles of printhead 31, the printhead spits ink onto blade 61, as indicated by step 94 of FIG. 11A, referred to as a "wetting" pass. The ink ejected from printerhead 31 moistens the distal tip of blade 61 and further moistens any dried ink and encrusted contaminants on nozzle plate 37. Some wiping occurs in this wetting pass. Following the wetting pass, printhead 31 is again drawn across blade 61 at a slow speed, preferably 1 inch per second, referred to as a "wiping" pass, indicated by step 96 of FIG. 11A. The wiping pass further loosens and removes any contaminants and rehydrated ink.

As indicated by the flow chart of FIG. 11A, the rehydrating scrub cycle of the present invention provides four wetting passes each followed by four wiping passes to ensure that nozzle plate 37 is free of contaminants. The wiping passes must occur before the ink ejected in the wetting passes begins to dry on the nozzle plate of the printhead and the wiper blade. It will be obvious to those reasonably skilled in the art that the number and sequence of wetting and wiping passes may be selected according to the ink used and the printing environment. More passes may be required for more viscous ink, for finer solid contaminants or for faster build up of contaminants. It will be further obvious to those reasonably skilled in the art how to program microprocessor 29 to achieve the desired type, number, sequence, of passes of the printhead 31 over blade 61.

The above described initial phase of the rehydrating scrub cycle is generally effective in removing encrusted contaminants from nozzle plate 37. However, due to the spitting of ink from color printhead 31, inadvertent mixing of colored ink on the nozzle plate 37 may occur. To eliminate the mixing of colored ink on nozzle plate 37, second and third phases of the rehydrating scrub cycle are executed.

In the second phase of the rehydrating scrub cycle, printer 10 executes a test pattern in which each nozzle of nozzle plate 37 prints a horizontal line to determine whether each nozzle is firing properly and to clear any mixing of ink which may have occured on nozzle plate 37. Next, a dense pattern of graphics in the form of bar graphs is printed to ensure that all nozzles for each color of printhead 31 are firing properly and to clear any mixing of ink which may have occurred on nozzle plate 37. Following the bar graph pattern, another print test pattern of horizontal lines for each nozzle is printed. This printing step of test patterns is indicated as step 98 of FIG. 11A. The printer operator visually inspects the printed test patterns to determine whether a problem exists with any particular nozzle or set of nozzles of printhead 31.

In the third and final phase of the rehydrating scrub cycle, a sequence of ink spitting and wiping passes is performed. As indicated by step 100 of FIG. 11B, printhead 31 spits ink ten times into spittoon 41. Next, four wiping passes are executed in which the printhead is drawn across the tip of blade 61 at a higher speed, preferably 6 inches per second. The combined sequence of 10 spits followed by four wiping passes is executed four times to further ensure removal of excess ink from nozzle plate 37 and allow the nozzles to spit out encrusted material which has been loosened during the previous phases of the rehydrating scrub cycle. The number and sequence of ink spitting and wiping passes of the third phase of the rehydrating scrub cycle, as well as the programming steps necessary to achieve the same, is an obvious design choice, similar with that of the initial phase.

It will be obvious to those reasonably skilled in the art that any number or sequence of wiping and wetting passes, spitting and printing may be chosen to achieve the desired result. The above described cycle is illustrative only and is not meant to be limiting.

Figure 11B:
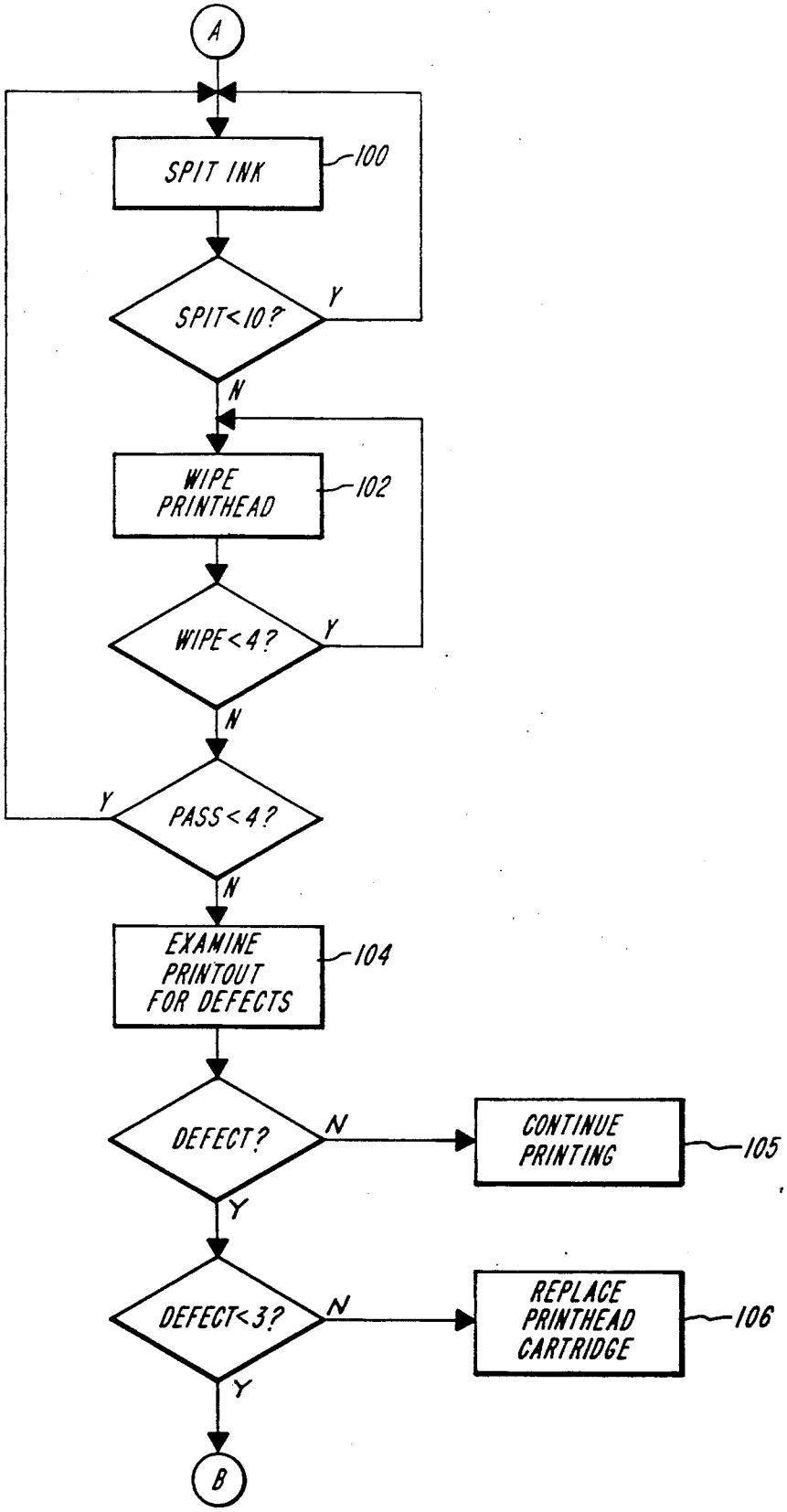
FIG. 11B is a flow chart of the third phase of the rehydration scrubbing cycle of FIG. 11A.

Following the third phase of the rehydrating scrub cycle, the operator of printer 10 examines the print quality for further defects, as indicated by step 104 of FIG. 11B. If the defects have been removed, normal printing operation continues, as indicated by step 105. If defects in print quality continue to exist, the rehydrating scrub cycle may be executed as many as three times. If a printing defect still exists, replacement of the printhead cartridge may be necessary, as indicated by step 106 of FIG. 11B.

It will be obvious to those reasonably skilled in the art that the rehydrating scrub cycle described above may be utilized with black printhead 33 in a manner similar to that utilized for freeing printhead 31 of contaminants. Because there is no danger of ink mixing on black printhead 33, fewer wiping and wetting passes may be required than the above described method. However, the steps of the rehydrating scrub cycle are substantially similar.

Figure 12:
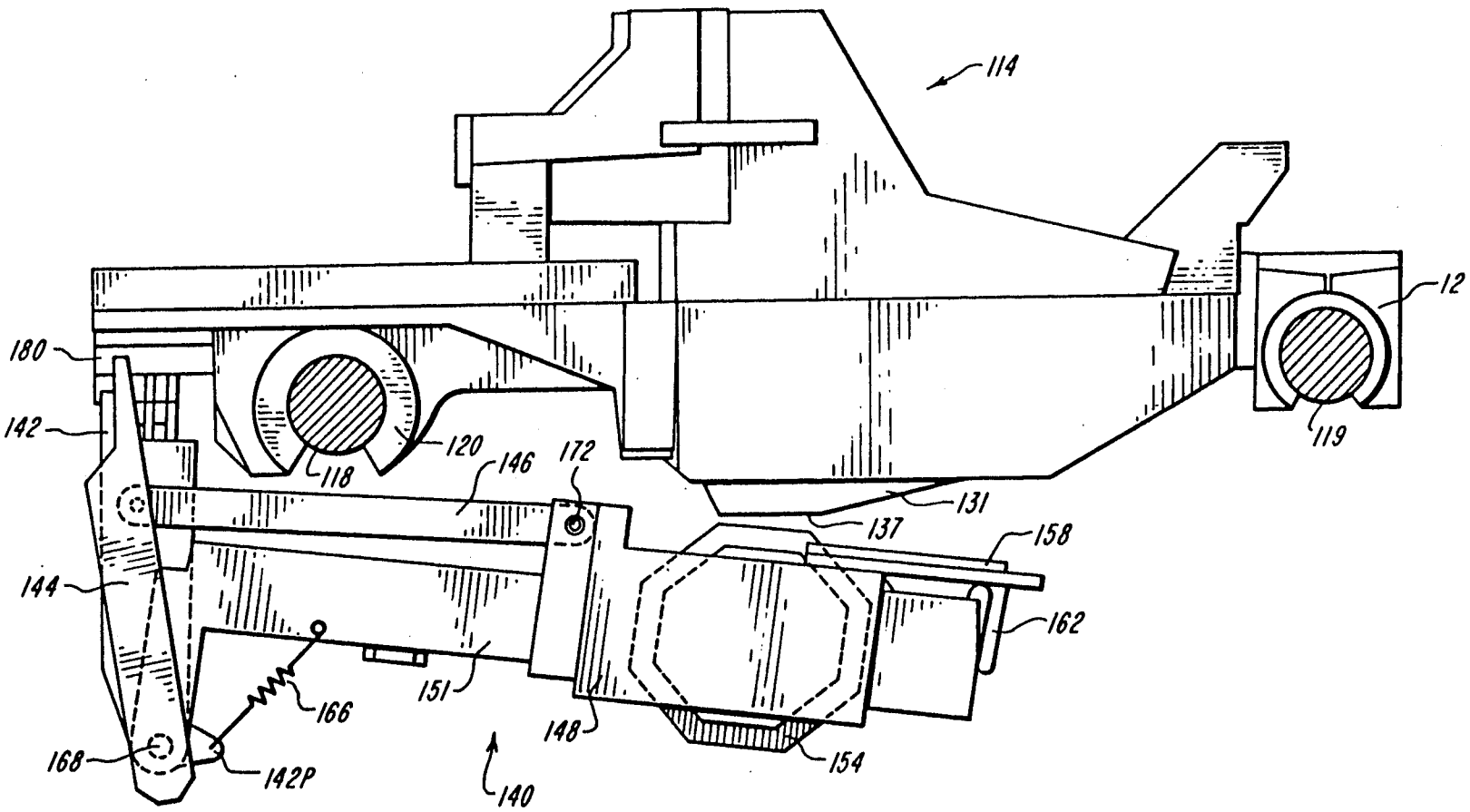
FIG. 12 is a side view of a second embodiment of the wiper of this invention illustrating its relationship to the printhead carriage and the printhead.

A second embodiment of the present invention, referred to generally as wiper mechanism 140, will now be described with particular reference to FIGS. 12–20. This second embodiment is particularly desirable in printers which require a high air-flow environment, as more vigorous scrubbing can be produced to remove dried ink and ink can be spit onto the blades to rehydrate the ink for each wiping operation. A typical inkjet printer 110 with which the wiper of the second embodiment of the present invention may be used is substantially similar to printer 10 of the first embodiment of the present invention, except that printhead carriage 114 travels back and forth through the printing zone on carriage rods 118 and 119. Accordingly, the configuration of printhead carriage 114 has been modified to receive the second carriage rod 119. Referring to FIG. 12, a side view of printhead carriage 114 is shown illustrating its relationship to wiper mechanism 140. Printhead carriage 114 is slidably mounted on carriage rods 118 and 119 which are received by carriage rod receptacles 120 and 121, respectively. Two carriage rods are preferred for greater accuracy in positioning the printhead carriage.

Printhead carriage 114 includes print cartridges 130 and 132. Print cartridge 130 includes color printhead 131 with nozzle plate 137 which are similar in function and design to printhead 31 and its nozzle plate 37 of printer 10 of the first embodiment. Similarly, print cartridge 130 includes black printhead 133, which is similar in function and design to black printhead 33 of printer 10 of the first embodiment. Unlike printheads 31 and 33, printheads 131 and 133 preferably are positioned at the same level on printhead carriage 114 and therefore have the same printhead to paper spacing. Otherwise, the means by which the printhead carriage 114 is positioned and the operation of the printheads 131 and 133 are similar to that of printer 10 of the first embodiment.

A cam 180 is secured to the rear of printhead carriage 114 to selectively engage wiper mechanism 140, depending on the position of printhead carriage 114, as explained hereinafter.

Figure 13:
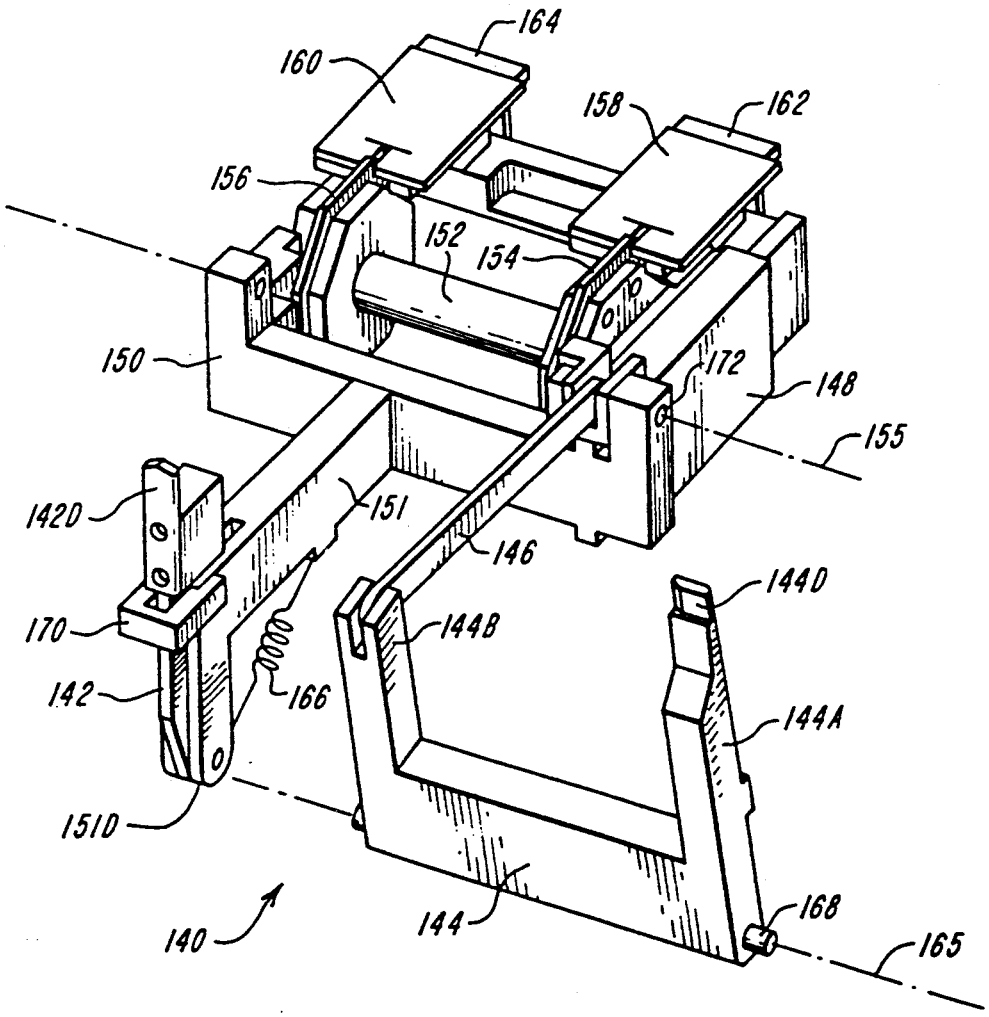
FIG. 13 is an isometric view of the wiper of FIG. 12.

Referring to FIGS. 12 and 13, wiper mechanism 140 is comprised of wiper frame 150, first cam follower 142, second cam follower 144, lever 146, slider mechanism 148, axle 152, color blade 154, black blade 156, blade cleaners 158 and 160, blade cleaner supports 162 and 164, spring 166, bosses 168, and disks 170.

As illustrated in FIG. 13, wiper frame 150 is generally rectangular in shape with a frame arm 151 extending perpendicularly from one side thereof. Wiper frame 150 is pivotally coupled to the machine frame in the service station at pivot point 172 to permit pivoting about axis 155. The distal end of frame arm 151 includes a pair of spaced downwardly facing legs 151D. A first cam follower 142 is disposed intermediate legs 151D and pivotally coupled at its proximal end 142P to the lower ends of the legs 151D. A distal tip 142D is disposed at the opposite end of cam follower 142. The extreme distal portion of tip 142D has a tapered shape to facilitate engaging cam 180, as explained hereinafter. The proximal end 142P of cam follower 142 has a tap tip which extends toward wiper frame 150, as illustrated in FIG. 13. The tab on proximal end 142P of cam follower 142 is coupled to arm 151 of wiper frame 150 by a coil spring 166 which biases first cam follower 142 in a direction away from wiper frame 150. A U-shaped stop 170 is attached to legs 151D of arm 151 to limit pivoting of cam follower 142 away from arm 151. A downward force, applied to distal tip 142D of cam follower 142 will cause wiper frame 150 to pivot about axis 155 at pivot point 172, as explained hereinafter.

A second cam follower 144 includes a generally U-shaped body portion with upwardly facing arms 144A and 144B, as illustrated in FIG. 13. A pair of bosses 168 project perpendicularly from the sides of cam follower 144 near its base. Bosses 168 enable cam follower 144 to be pivotally mounted to the machine frame in the service station of printer 110. Arm 144A of cam follower 144 includes a distal tip 144D which has a configuration of lateral surfaces adapted to interact with cam 180 of printhead carriage 114, as explained hereinafter. Arm 144B of cam follower 144 has a pair of spaced legs. A lever 146 is disposed between the legs and is pivotally coupled thereto.

The second end of lever 146 is pivotally coupled to a slider mechanism 148 which is in turn slidably mounted about one side of wiper frame 150 in a sleeve-like manner. Slider 148 is coupled to a conventional ratchet mechanism 149 which converts the reciprocating motion of slider 148 into a rotary motion for rotation of the wiper blades, as explained hereinafter.

An axle 152, having a pair of octagonal-shaped disks at each end thereof, is rotatably mounted at each end in wiper frame 150. A wiper blade 154 is disposed intermediate octagonal disks 172 at one end of axle 152, and an octagonal-shaped wiper blade 156 is disposed intermediate octagonal disks 174 at the opposite end of axle 152. Disks 174 should have the same configuration as blades 154 and 156. A series of flat edges should be provided on each blade 154 and 156. Blades 154 and 156 have a polygonal shape and may be square, or hexagonal or some other configuration. However, the preferred configuration is octagonal. Wiper blades 154 and 156 are preferably formed of a resilient material such as nitrile rubber or the like so that as a printhead passes over the wiper blade, the blade flexes to accommodate the irregular surface of the printhead and then returns to its original configuration without substantial deformation. The exterior disk 174 adjacent wiper 154 is coupled to ratchet mechanism 149 so that axle 152 and blades 154 and 156 will rotate in a clockwise direction when slider 148 activates ratchet mechanism 149 in a conventional manner which is well understood by those skilled in the art.

A pair of blade cleaners, 158 and 160, preferably each comprised of an absorbent material, and having a slit in one side thereof is mounted to wiper frame 150 by support members 162 and 164, respectively. Blade wipers 158 and 160 are positioned to receive the perimeter of blades 154 and 156 respectively within their slits in tight frictional engagements to wipe the edges of their respective blades. As wiper blades 154 and 156 are indexed, they pass through the slit in blade cleaners 158 and 160, respectively, and the top and sides of the most recently used blade edges are freed of ink, dust, lint and any other contaminants which may be adhered thereto. Also, wipers 158 and 160 help to retain blades 154 and 156 in their indexed position to prevent movement thereof during wiping, as will be described hereinafter. Wipers 158 and 160 are preferably comprised of a contaminant-free, ink-absorbing material which wicks the ink away from the blades. An acceptable, commercially available material is sold under the trade name Texwipe, by Texwipe Corporation.

It may be appreciated from the previous explanation that the wiper mechanism 140 of the second embodiment of the present invention, when pivotally mounted to the service station of printer 110, provides contact between wiper blades 154 and 156 and printheads 131 and 132 respectively, depending upon the position of printhead carriage 114 in relative to wiper mechanism 140. Blade 154 only wipes printhead 131 and blade 156 only wipes printhead 132 to prevent cross-contamination.

This engagement occurs as follows. Cam 180, attached to printhead carriage 114, has a plurality of camming surfaces separated by dividing walls. As printhead carriage 114 advances towards the service station of printer 110, first cam follower 142 engages cam 180. As printhead carriage 114 continues in its rightwardly motion, the distal tip 142D of cam follower 142 rides up on the camming surfaces of cam 180 which pushes follower 142 downwardly and causes a pivoting of wiper frame 150 about axis 155. A corresponding but opposite upward displacement of wiper blades 154 and 156 is produced. By providing cam 180 with a plurality of selectively contoured grooves which cause variations in vertical displacement of cam follower 142 as the position of cam 180 and printhead carriage 114 change, wiper blades 154 and 156 may be selectively deflected upward to contact printheads 131 and 133, respectively, as printhead carriage 114 passes over wiper mechanism 140. When printhead carriage 114 is reciprocated back and forth in an oscillating manner over wiper mechanism 140, wiper blades 154 and 156 will be brought into selective contact with printheads 131 and 133, respectively, to allow for wiping thereof. As with the first embodiment of the present invention, the wiper blades remain stationary while the nozzle plate of the printhead is drawn back and forth across the wiper blade in an oscillating manner. Unlike the first embodiment, however, both the color printhead 131 and the black printhead 133 are wiped simultaneously.

As printhead carriage 114 and cam 180 travel further in a rightwardly direction, cam 180 engages second cam follower 144 causing an indexing of wiper blades 154 and 154. The indexing of wiper blades 154 and 156 occurs as follows. As printhead carriage 114 continues into the service station area of printer 110, cam 180 disengages first cam follower 142 and engages second cam follower 144. Cam 180 selectively deflects distal tip 144D of second cam follower 144. The deflection of distal tip 144D causes pivotal rotation of cam follower 144 about axis 165. The rotary motion of cam follower 144 is translated into a reciprocating motion by lever 146 which is pivotally coupled to both cam follower 144 and slider 148. Slider 148 imparts the reciprocating motion to ratchet mechanism 149 which in turn rotates axle 152 and wiper blades 154 and 156 so that the next available edge of each octagonal blade is facing upwardly. As wiper blades 154 and 156 rotate, the blade used in the most recent wiping of the printheads is drawn through the slit in blade cleaners 158 and 160 respectively causing a cleaning thereof.

Figure 14:
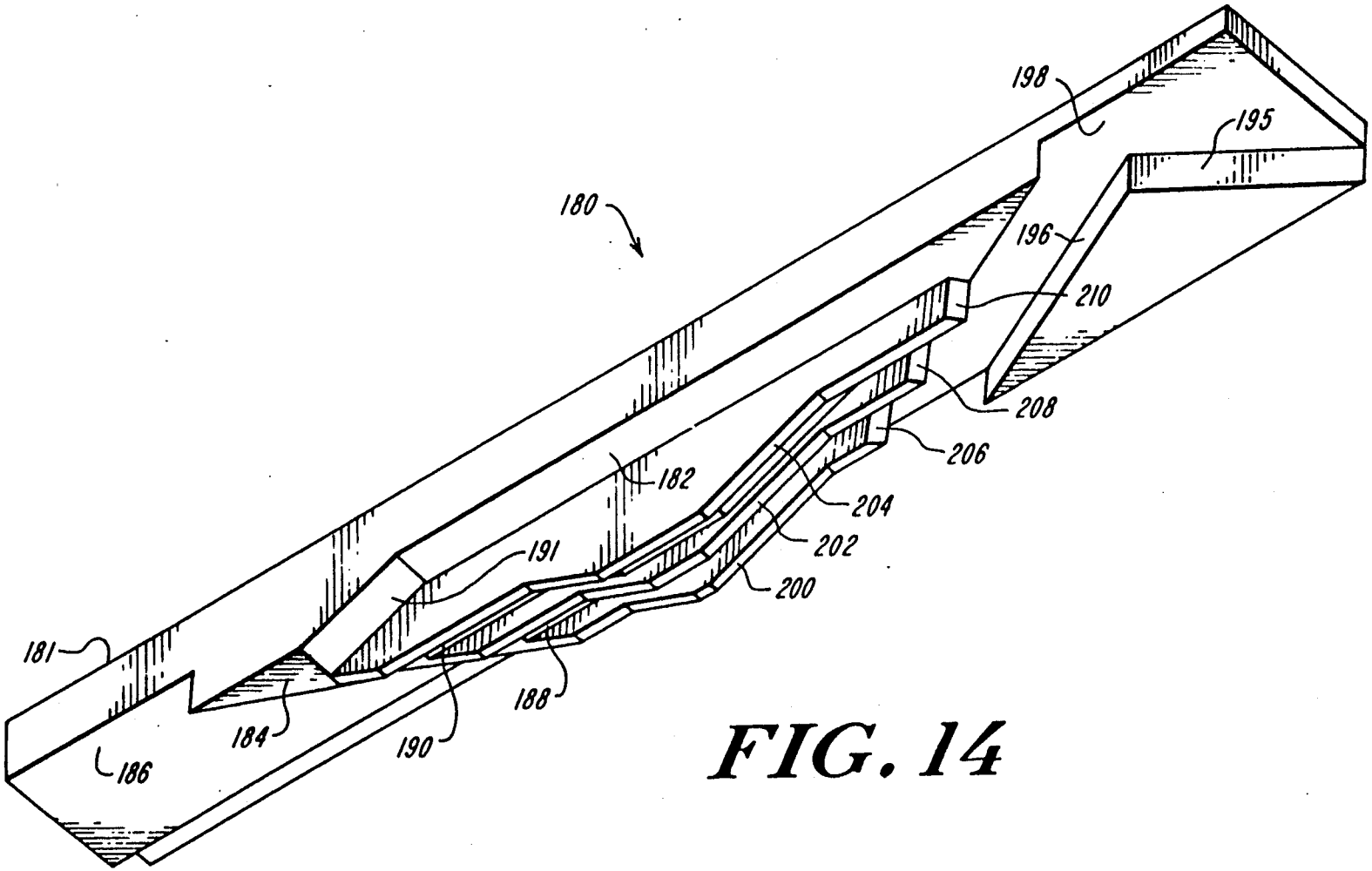
FIG. 14 is a perspective view of the cam carried by the printhead carriage of FIG. 12.
Figure 15:
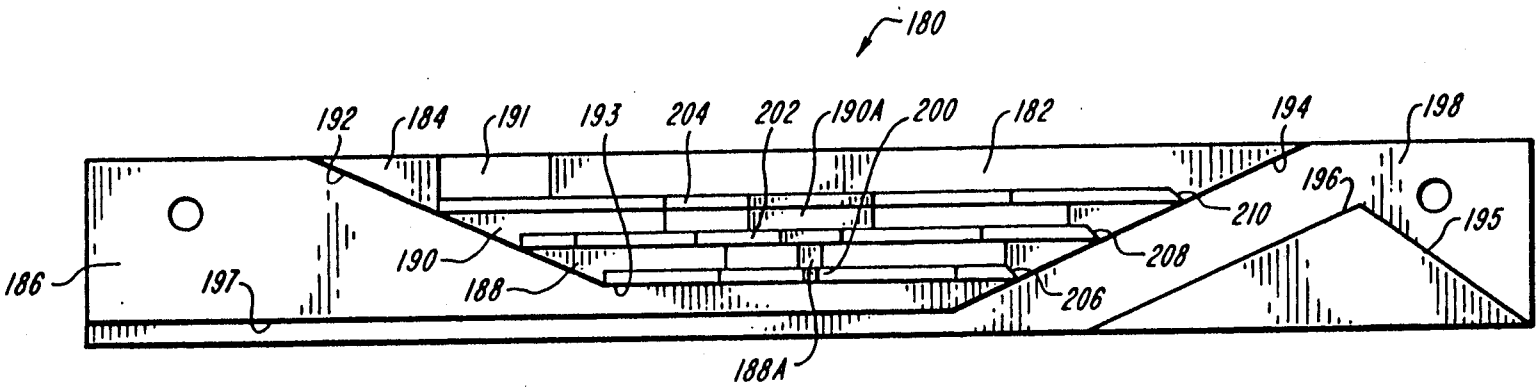
FIG. 15 is a bottom, plan view of the cam of FIG. 14.

Referring to FIGS. 14 and 15, a preferred cam 180 contemplated for use with the second embodiment of the present invention is illustrated. Cam 180 has a flat, rectangular top surface from which a number of camming surfaces, ramps and grooves project downwardly. Cam 180 comprises top surface 181, cam surfaces 182, 184 and 186, cam grooves 188, 190, and 198, ramps 191-197, walls 200, 202 and 204, and release surfaces 206, 208 and 210.

As illustrated in FIGS. 14 and 15, cam surfaces 182, 184, and 186 and cam groove 198 lie in planes parallel to top surface 181. Ramps 192 and 193 extend perpendicularly from cam surface 186. Ramps 194, 195, 196 and 197 extend perpendicularly from cam groove 198.

Walls 200, 202, and 204 extend perpendicularly from cam surface 182. Cam groove 188 lies intermediate walls 200 and 202. Cam groove 190 lies intermediate wall 202 and 204. The surfaces which comprise cam grooves 188 and 190 lie in planes which are parallel to the top surfaces their adjacent walls. Ramp 191 extends between cam surfaces 182 and 184 and lies adjacent wall 204. Wall 200 is terminated at one end by an oblique surface, designated release surface 206. Similarly, walls 202 and 204, are terminated by oblique surfaces, designated release surfaces 208 and 210, respectively.

Cam 180 is preferably comprised of a rigid material such as plastic or the like so that the cam will not deform when engaged by cam followers 142 and 144, causing unintended displacements or deflections thereof as cam 180 moves over the cam followers.

Figure 17:
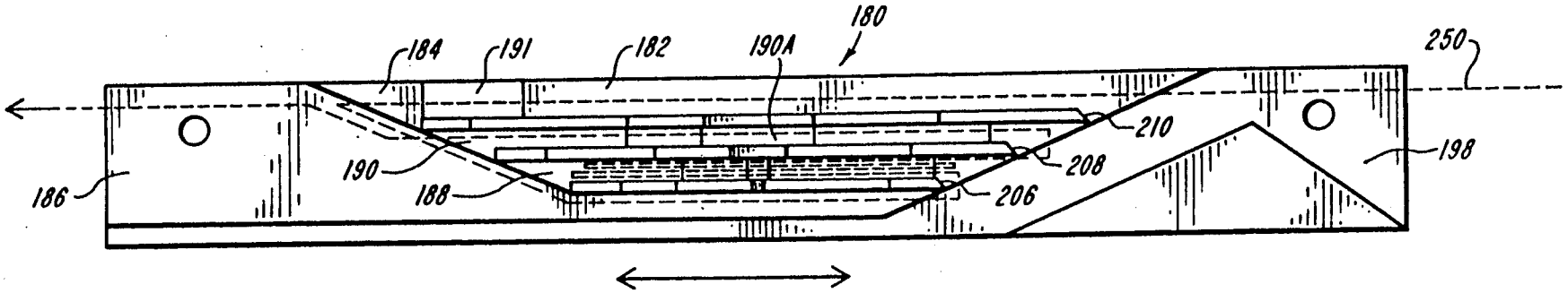
FIG. 17 is a bottom, plan view of the cam of FIG. 14 illustrating the path of the cam over the wiper mechanism to facilitate wiping of the printheads.
Figure 16:
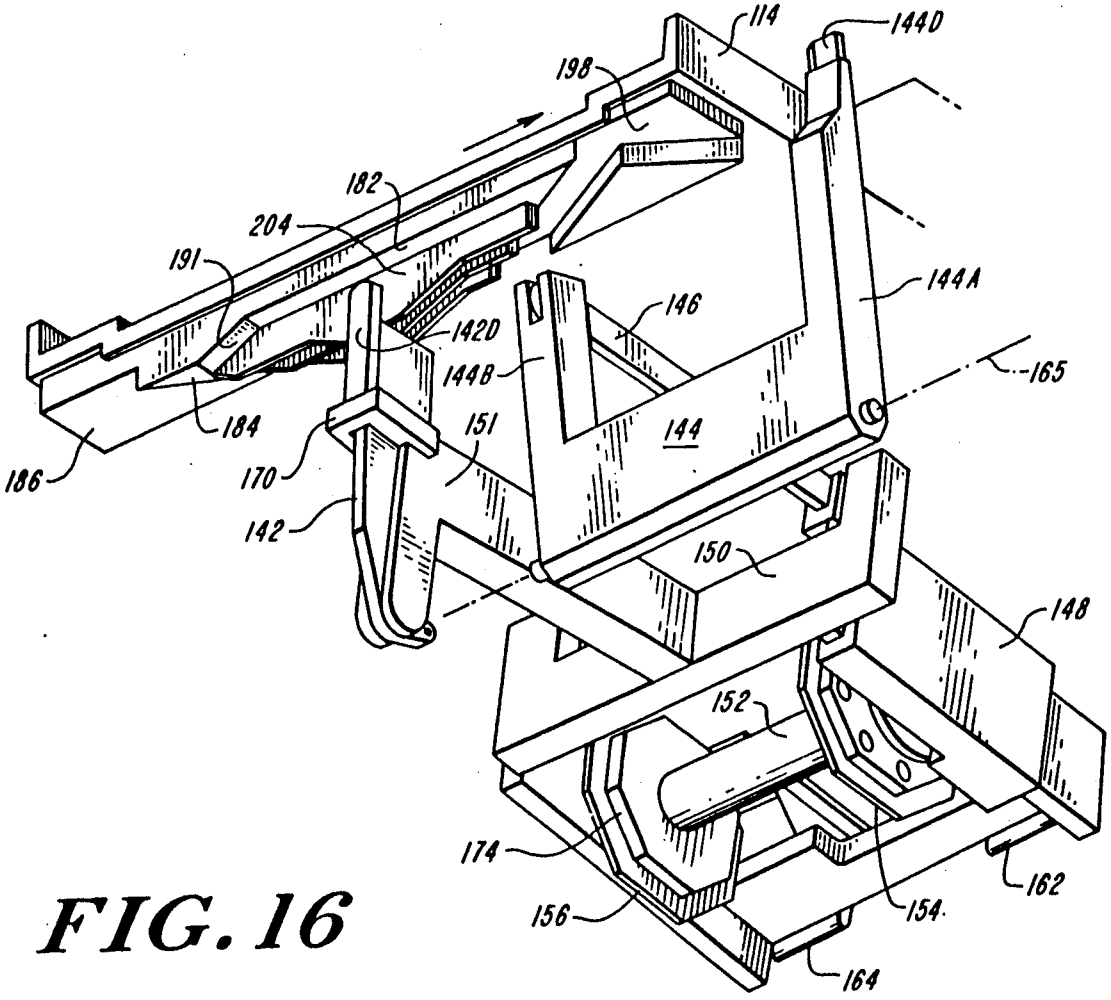
FIG. 16 is a partial, prospective view of the wiper embodiment of FIG. 12 illustrating the relationship of the wiper to the cam as the printhead carriage approaches the service area.

A description of the engagement of wiper 140 and cam 180 to facilitate wiping of printheads 131 and 133 will be described with reference to FIGS. 16-20. All directions, such as right and left are provided with reference to FIGS. 16-20. Referring to FIGS. 16 and 17, as printhead carriage 114 advances rightwardly toward the service station of printer 110, cam 180 engages first cam follower 142. The path of cam 180 across distal tip 142D of cam follower 142 is illustrated by dashed line 250 in FIG. 17. As printhead carriage 114 moves rightwardly, cam surface 182 moves over distal tip 142D. When the center of cam surface 182 passes over distal tip 142D, printheads 131 and 133 eject or spit into onto wiper blades 154 and 156, respectively. The wetting of blades 154 and 156 helps to remove dehydrated ink and other encrusted contaminants from nozzle plates 137 and 139, respectively, as explained hereinafter. As cam 180 continues rightwardly, distal tip 142D contacts ramp 191 which displaces tip 142D downwardly causing wiper frame 150 to pivot about axis 155 and displace blades 154 and 156 upward into close proximity of the printheads 131 and 133, respectively. As cam 180 continues its rightward, movement cam surface 184 maintains the displacement of cam follower 142 and maintains blades 154 and 156 in close proximity to nozzle plates 137 and 139 of printheads 131 and 133, respectively.

As cam 180 continues rightwardly, distal tip 142D reaches the edge of cam surface 184 and pivots upward to its normal position causing a corresponding downward movement of wiper blades of 154 and 156 away from printheads 131 and 133, respectively.

Printhead carriage 114 then changes direction, now moving leftwardly. As cam 180 continues to the left, tip 142D, which is spring biased away from wiper 140, contacts ramp 192 and is deflected thereby. Tip 142D is increasingly deflected as it follows ramp 192. Upon reaching the end of ramp 192, tip 142D follow ramp 193 which maintain its deflection, as cam 180 continues leftward. Upon reaching the edge of ramp 193, tip 142D pivots, because of its spring bias, into cam groove 188.

Figure 18:
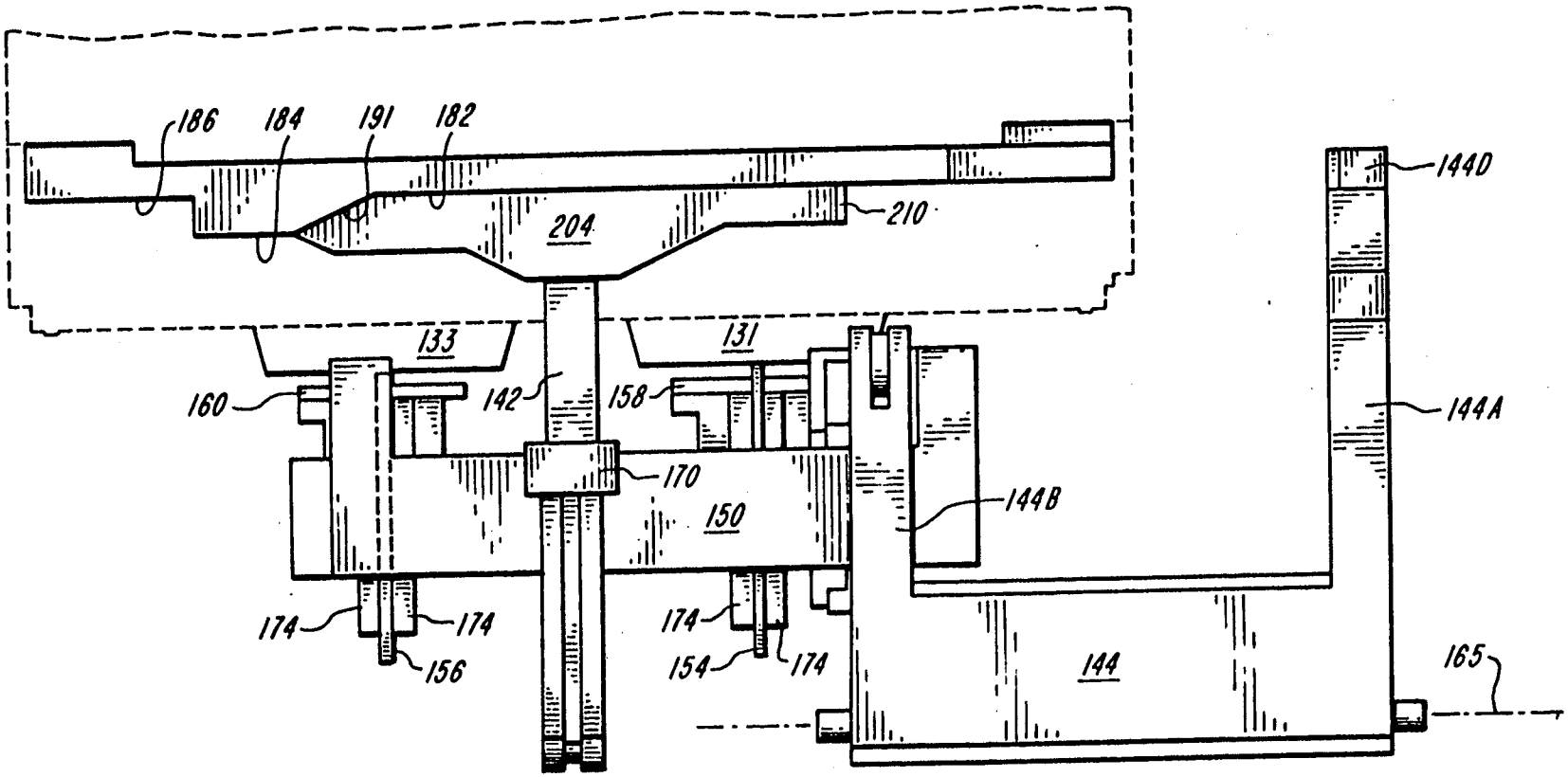
FIG. 18 is a rear, plan view of the wiper embodiment of FIG. 12 illustrating the engagement of the cam and wiper mechanism to facilitate wiping of the printheads.

At this point, printhead carriage 114 again reverses direction now moving rightwardly. As cam 180 continues rightwardly, distal tip 142D, retained by walls 200 and 202, contacts cam groove 188 which causes a gradual downward displacement of tip 142D and a corresponding gradual, upward displacement of blades 154 and 156. When surface 188A, at the center of cam groove 188 reaches tip 142D, the displacement of tip 142D and blades 154 and 156 remains constant. At this point, blades 154 and 156 are in contact with nozzle plates 137 and 139, respectively as shown in FIG. 18.

As printhead carriage 114 and cam 180 continue respectively rightwardly, nozzle plates 137 and 139 are drawn across blades 154 and 156, respectively. The ink previously deposited on the blades helps to rehydrate dried ink on the nozzle plates and loosen encrusted contaminants as the nozzle plates are drawn across the blade tips. The resulting wiping action is referred to as a "short" or "scrub" stroke. Each "scrub" stroke should occur before the ink previously ejected begins to dry on the nozzle plates and the wiper blades. As printhead carriage 114 continues rightwardly, tip 142D is gradually displaced upwardly, causing blades 154 and 156 to be gradually displaced downwardly. At this point, printhead carriage 114 and cam 180 changes directions, moving leftwardly so that cam groove 188 displaces tip 142D downwardly a second time causing a second short scrub stroke of the printheads.

It will be obvious to those reasonably skilled in the art that once tip 142D is positioned within cam groove 188 subsequent scrub stroke wipings of printheads 131 and 133 may be achieved by simply reversing the direction of printhead carriage 114 and cam 180, in an oscillating manner. In the preferred embodiment, cam 180 reverses direction three times causing four "scrub" strokes as nozzle plates 137 and 139 are dragged across wiper blades 154 and 156, respectively. These scrub strokes loosen dust, lint, dried ink and other contaminants from the nozzle plates. In the preferred embodiment, cam groove 188 is drawn across distal tip 142D at a rate of approximately three inches per second. However, both this value or the number of strokes should not be considered limiting in any manner.

Following the last scrub stroke, cam 180 is moving leftwardly with distal tip 142D biased against wall 202. Upon reaching the edge of wall 202, at release point 208, tip 142D, because of its spring bias, pivots into cam groove 190, as indicated in FIG. 17. At this point, printhead carriage 114 again changes direction, now moving rightwardly. As printhead cam 180 continues rightwardly, cam groove 190 is drawn across distal tip 142D causing a gradual, downward, displacement thereof and a corresponding gradual, upward displacement of blades 154 and 156. When surface 198A, at the center of cam groove 190, is drawn across distal tip 142D, cam follower 142 reaches a constant vertical displacement. At this point, blades 154 and 156 are in contact with nozzle plates 137 and 139, respectively. As printhead carriage 114 continues rightwardly, nozzle plates 137 and 139 are drawn across blades 154 and 156, respectively, as long as distal tip 142D is in contact with cam surface 190A.

As illustrated in FIG. 17, surface 190A is considerably larger than surface 188A allowing for greater contact between the wiper blades and the nozzle plates. The resulting wiping action is referred to as a "wiping" stroke. In the preferred embodiment, the cam groove 190 is drawn across distal tip 142D at a rate of approximately twelve inches per second, causing nozzle plates 137 and 139 to be drawn across wiper blades 154 and 156, respectively, at the same rate. It should be understood that the speed with which printhead carriage 114 and cam 180 are drawn across wiper mechanism 140 may vary according to the environment and the viscosity of the ink used in ink-jet printer 110. The above rate used in the preferred embodiment should not be interpreted as limiting in any manner.

As cam 180 continues rightwardly, distal tip 142D reaches the edge of cam groove 190 and is displaced upwardly therefrom. Tip 142D is biased against ramp 192 which it follows until reaching its neutral position. As printhead carriage 114 and cam 180 continue rightwardly, surface 186 moves above distal tip 142D without contact.

As printhead carriage 114 continues rightwardly, second cam follower 144 of wiper mechanism 140 engages cam 180. As cam 180 moves farther rightwardly, second cam follower 144 is received within cam groove 198 which moves above distal tip 144D in a noncontacting manner. As cam 180 continues rightwardly distal tip 144D contacts ramp 194 and is increasingly deflected thereby, following the path indicated by dashed line 260 of FIG. 19. The deflection of distal tip 144D causes pivotal rotation of cam follower 144 about axis 165. The rotary motion of cam follower 144 is translated into a reciprocating motion by lever 146 which is pivotally coupled to both cam follower 144 and slider 148. Slider 148 imparts the reciprocating motion to ratchet mechanism 149 which in turn rotates axle 152 and wiper blades 154 and 156 so that the next available edge of each octagonal blade is facing upwardly. As wiper blades 154 and 156 rotate, the blade edges used in the most recent wiping of the printheads are drawn through the slits blade cleaners 158 and 160, respectively, causing a cleaning thereof.

Figure 19:
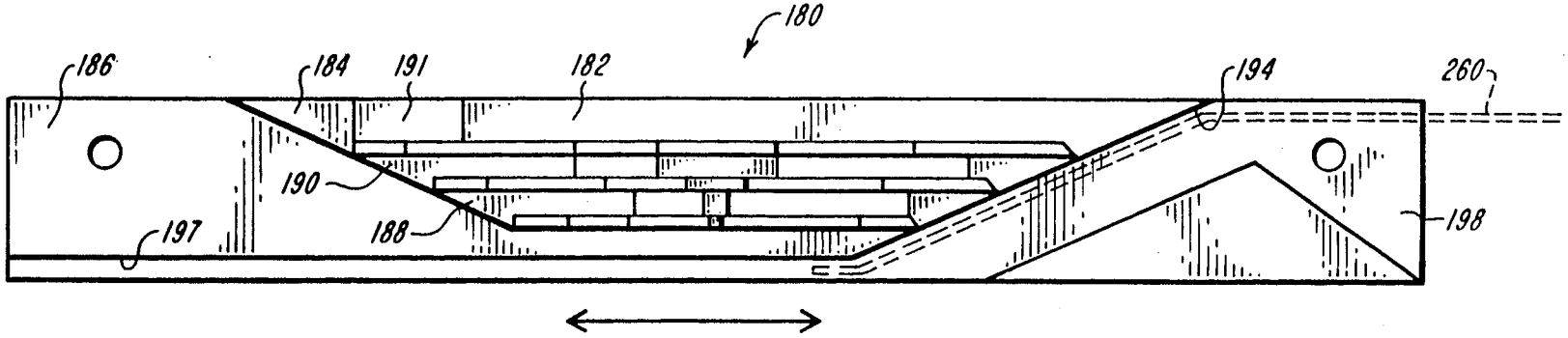
FIG. 19 is a bottom, plan view of the cam of FIG. 14 illustrating the path of the cam over the wiper mechanism to facilitate rotation of the wiper blades.

As printhead carriage 114 continues rightwardly distal tip 144D contacts ramp 197 and remains in a deflected position, as indicated in FIG. 19 as printhead carriage 114 comes to rest in the service station area. Printhead carriage 114 is then in a position, as previously described with regard to the first embodiment of the present invention, in which printheads 131 and 133 are capped. When a print request is received, printhead carriage 114 leaves the service area moving leftwardly, causing distal tip 144D of second cam follower 144 to disengage from cam 180, following the same path as that of its initial engagement except in reverse, as indicated in FIG. 19.

Figure 20:
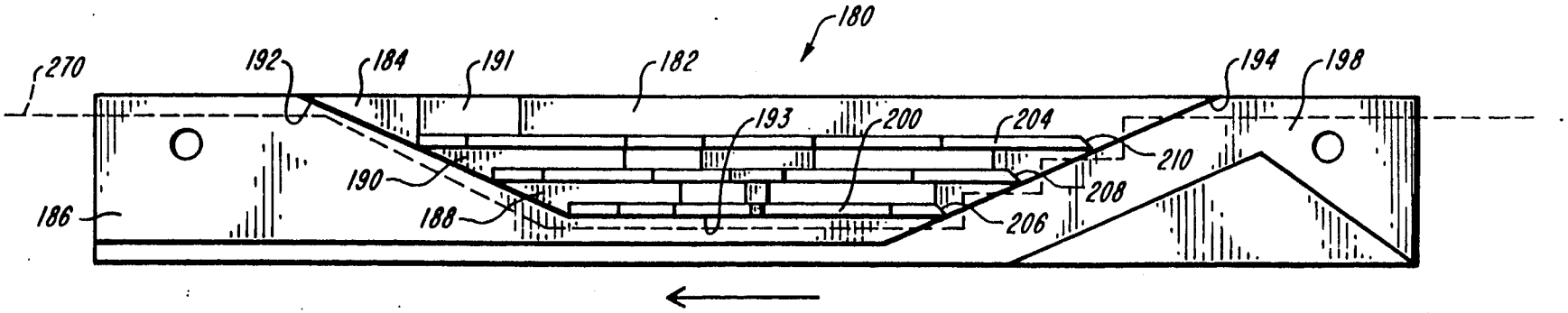
FIG. 20 is a bottom, plan view of the cam of FIG. 14 illustrating the path of the cam over the wiper mechanism as the printhead carriage exits from the service area.

As printhead carriage 114 and cam 180 continue leftwardly, cam 180 re-engages distal tip 142D of first cam follower 142, as shown by dashed line 270 in FIG. 20. Cam surface 186 moves above distal tip 142 in a noncontacting manner. As cam 180 continues leftward, tip 142D is deflected by ramp 192. Tip 142D is deflected by ramp 192 which it follows until reaching ramp 193. As cam 180 continues leftwardly, tip 142D follows ramp 193 until reaching release point 206. At release point 206, tip 142D pivots against wall 202 which it follows briefly until reaching release point 208. At release point 208, tip 142D pivots against wall 204 which it follows briefly until reaching release point 210. At release point 210, tip 142D is biased to its normal position. As cam 180 continues leftward, surface 182 and cam groove 198 move over distal tip 142D, without further contact as printhead carriage 114 moves into the print zone, as indicated in FIG. 20.

It may be appreciated from the above description that as printhead carriage 114 exits from the service station area, the contact between cam 180 and the cam followers does not cause further pivoting of wiper frame 150 or rotation of blades 154 and 156, and no wiping or blade rotation occurs. In the preferred embodiment, the wiping of printheads 131 and 133 may occur at the end of every page. It may be appreciated, however, that the wiping sequence may occur at more frequent intervals as desired.

The interaction of cam 180 and wiper mechanism 140 as described above enables printheads 131 and 133 to be wiped, and the blades of the wiper mechanism to be rotated depending on the position of printhead carriage 114 and cam 180. In the preferred embodiment, printhead carriage 114 is oscillated in a back and forth manner to provide four short "scrub" strokes followed by one long "wipe" stroke, and further followed by a rotation of wiper blades 154 and 156 prior to capping of printheads 131 and 133. It will be obvious to those reasonably skilled in the art that the position of printhead carriage 114 may be manipulated to achieve other sequences or types of wiping action, the instructional algorithms used to manipulate the printhead carriage 114 for such actions being obvious to those reasonably skilled in the art. Also, it will also be obvious to those reasonably skilled in the art that the surfaces of cam 180 may be modified to achieve different deflections and displacements of cam followers 144 and 142 to achieve different pivoting and rotation of wiper blades 154 and 156. Also, the points at which ink is spit on to the blades can be adjusted or eliminated entirely, depending upon the requirements of the particular printer with which this invention is used.

The wiper of this invention permits the removal of dust, ink and other contaminants from color and black printheads, and prevents their buildup during use. Cross contamination of the printheads is prevented, and automatic self cleaning is provided.

In view of the above description, it is likely that modifications and improvements will occur to those skilled in the art which are within the scope of this invention. The above description is intended to be exemplary only, the scope of the invention being defined by the following claims and their equivalents.

What is claimed is:

1. Apparatus for cleaning first and second printheads disposed on a printhead carriage in an ink-jet printer comprising:

a first wiper blade for wiping a first printhead;

a second wiper blade for wiping a second printhead;

means, responsive to movement of the printhead carriage, for selectively bringing said first wiper blade into wiping contact only with said first printhead, and for selectively bringing said second wiper blade into wiping contact only with said second printhead; and means for moving the printhead carriage to produce relative wiping motion between said first printhead and said first wiper blade and said second printhead and said second wiper blade, said moving means limiting movement of the printhead carriage to prevent wiping of the first printhead by the second wiper blade and the second printhead by the first wiper blade.

2. Apparatus as recited in claim 1 wherein the printhead carriage travels bidirectionally through a printing zone in which printing is produced by the first and second printheads on a print medium and wherein said first and second wiper blades are disposed in a service station area disposed outside of said printing zone adjacent one end of the printing zone.

3. Apparatus as recited in claim 1 wherein surfaces on the printhead carriage mechanically interact with at least one arm associated with said bringing means to cause said bringing means to selectively bring said first wiper blade into wiping contact only with said first printhead and to selectively bring said second wiper blade into wiping contact only with said second printhead.

4. Apparatus as recited in claim 1 wherein said moving means comprises:

a motor;

means coupling said motor to the printhead carriage;

computer means for controlling said motor and said coupling means; and means for guiding movement of the printhead carriage in said service station area.

5. Apparatus as recited in claim 1 further comprising means for removing contaminants from said first and said second wiper blades.

6. Apparatus as recited in claim 5 wherein said removing means comprises at least one scraper.

7. Apparatus as recited in claim 1 further comprising a third wiper blade for cleaning the first printhead and a fourth wiper blade for cleaning the second printhead.

8. Apparatus as recited in claim 1 wherein said first and said second wiper blades each have a polygonal shape and a central axis of rotation passing through a center thereof.

9. Apparatus as recited in claim 8 wherein said bringing means comprises:

a cam coupled to the printhead carriage;

a pivotally mounted frame to which said first and second blades are secured; and a cam follower responsive to movement of said cam for pivoting said frame about an axis of rotation.

10. Apparatus as recited in claim 9 in which said first and second wiper blades are selectively pivoted into contact with said first printhead and said second printhead, respectively, in response to said cam.

11. Apparatus as recited in claim 9 further comprising indexing means for rotating said first and said second wiper blades about said central axis of rotation.

12. Apparatus as recited in claim 11 comprising first and second absorbent members disposed in frictional contact with said first and second wiper blades, respectively, for absorbing contaminants as said wiper blades are rotated.

13. Apparatus for cleaning first and second printheads disposed on a printhead carriage in an ink-jet printer comprising:

a first wiper blade for wiping a first printhead;

a second wiper blade for wiping a second printhead;

means for selectively bringing said first wiper blade into wiping contact only with said first printhead, and for selectively bringing said second wiper blade into wiping contact only with said second printhead; and means for producing relative wiping motion between said first printhead and said first wiper blade and said second printhead and said second wiper blade, wherein said first wiper blade and said second wiper blade extend from a wiper body rotable about a central axis.

14. Apparatus as recited in claim 13 wherein said first and second wiper blades extend generally radially outwardly from said central axis and have distal tips which are spaced from one another.

15. Apparatus as described in claim 14 wherein said first wiper blade and said second wiper blade each have a length extending from its distal tip to said axis of rotation, wherein the length of said first wiper blade is different from the length of said second wiper blade, and wherein said first printhead has a printhead to paper spacing different from the printhead to paper spacing of the second printhead.

16. Apparatus as recited in claim 13 wherein said bringing means comprises means for rotating said wiper body about said central axis of rotation.

17. Apparatus as recited in claim 16 wherein said rotating means is responsive to movement of the printhead carriage.

18. Apparatus as recited in claim 17 wherein said rotating means comprises a lever arm actuated by movement of the printhead carriage.

19. Apparatus as recited in claim 18 wherein said lever arm is selectively actuated by movement of the printhead carriage in only one direction.

20. A method for cleaning first and second printheads disposed on a printhead carriage in an ink-jet printer comprising the steps of:

a. ejecting ink from the first printhead while the printhead carriage is disposed in a service station area of the printer;

b. bringing a first wiper blade into wiping contact with the first printhead before the ejected ink dries;

c. moving the printhead carriage with a reciprocating motion to effect wiping of the first printhead by only the first wiper blade, d. ejecting ink from the second printhead while the printhead carriage is disposed in a service station area of the printer;

e. bringing a second wiper blade into wiping contact with the second printhead before the ejected ink dries; and f. moving the printhead carriage with a reciprocating motion to effect wiping of the second printhead carriage by only the second wiper blade.

21. The method of claim 20 further comprising the step of printing a graphic test pattern which requires ink to be ejected from every orifice in in the orifice plates of the first and second printhead.

22. The method of claim 21 further comprising the step of examining the printed test pattern for printing defects.

23. The method of claim 20 wherein steps (a) and (d) are executed simultaneously, and steps (b) and (e) are executed simultaneously.

24. The method of claim 23 wherein steps (a), (b), (d), and (e) are executed simultaneously.

25. The method of claim 20 wherein steps (a) through (c) are executed sequentially followed by the sequential execution of steps (d) through (f).

26. Apparatus for cleaning the orifice plates of first and second printheads disposed on a printhead carriage in an ink-jet printer, said printheads each being adapted to selectively expel ink onto a medium to effect recordation thereof, comprising:

a carriage for carrying first and second printheads;

a station for servicing said first and second printheads;

means for moving said carriage into said service station;

a first wiper means for cleaning the orifice plate of the first printhead;

a second wiper means for cleaning the orifice plate of the second printhead;

means for causing the first and second printheads to selectively expel ink from the orifice plates when the printhead carriage is disposed in the service station;

means, responsive to movement of the printhead carriage, for selectively bringing said first wiper means into wiping contact with said first printhead orifice plate and for selectively bringing said second wiper means into wiping contact with said second printhead orifice plate before the expelled ink dries; and means for moving said printhead carriage with respect to said first and said second wiper means to produce a relative wiping motion between said first wiper means and the orifice plate of said first printhead and between said second wiper means and the orifice plate of said second printhead.

27. Apparatus as recited in claim 26 wherein said first wiper means and said second wiper means are stationary and wherein said carriage moves with respect to said first and said second wiper means to produce wiping action.

28. Apparatus as recited in claim 26 wherein said bringing means and said expelling means are actuated simultaneously.

29. Apparatus as recited in claim 26 wherein said bringing means and said expelling means are actuated sequentially.

30. Apparatus for cleaning the orifice plates of first and second printheads disposed in a printhead carriage in an ink-jet printer comprising:

a wiper rotatable about an axis passing through a center thereof;

a first blade extending from said wiper in a direction generally parallel to a radius passing through said axis;

a second blade extending from said wiper in a direction generally parallel to a radius passing through said axis;

means responsive to movement of the printhead carriage for rotating said wiper to selectively bring said first wiper blade into contact with said first printhead and said second wiper blade into contact with said second printhead, one of said first and said second wiper blades having a radial extent greater than the other of said first and second wiper blades, said one of said wiper blades being associated with a printhead orifice plate having a greater printhead-to paper spacing than another of the printhead orifice plates; and means for moving said printhead carriage with respect to said wiper to produce selective wiping action between said first wiper blade and said first printhead and said second wiper blade and said second printhead.

31. Apparatus for cleaning the orifice plates of and second printheads disposed on a printhead carriage in an ink jet printer comprising:

a frame rotatably mounted in the printer;

a first polygonal blade rotatably mounted in said frame, said first blade being associated with the first printhead;

a second polygonal blade rotatably mounted in said frame, said second blade being associated with the second printhead;

means responsive to movement of the printhead carriage for pivoting said frame about an axis to position said first blade adjacent said first printhead and said second blade adjacent said second printhead; and means for moving the printhead carriage with respect to said frame to produce wiping action action between said first blade and the first printhead and said second blade and the second printhead, said moving means limiting movement of the printhead carriage to prevent wiping of the first printhead by said second wiper and the second printhead by said first wiper.

32. Apparatus as recited in claim 31 wherein said means responsive to movement of the printhead carriage is actuated by mechanical contact between the printhead carriage and said means responsive to movement of the printhead carriage.

33. Apparatus for cleaning first and second printheads disposed on a printhead carriage in an ink-jet printer comprising:

a first wiper blade for wiping a first printhead;

a second wiper blade for wiping a second printhead;

means responsive to movement of the printhead carriage for selectively bringing said first wiper blade into wiping contact only with the first printhead, and for selectively bringing said second wiper blade into wiping contact only with the second printhead; and means for moving the printhead carriage with respect to said wiper blades while retaining said wiper blades in a stationary position to produce wiping action between the first wiper blade and the first printhead and the second wiper blade and the second printhead, said moving means limiting movement of the printhead carriage to prevent wiping of the first printhead by the second wiper blade and the second printhead by the first wiper blade.

34. Apparatus as recited in claim 33 wherein said means responsive to movement of the printhead carriage is actuated by mechanical contact between the printhead carriage and said means responsive to movement of the printhead carriage.

35. Apparatus as recited in claim 33 wherein said means for moving the printhead carriage produces wiping action between the first wiper blade and the first printhead simultaneously with wiper action between the second wiper blade and the second printhead.

36. Apparatus as recited in claim 33 wherein said means for moving the printhead carriage produces wiping action between the first wiper blade and the first printhead followed by wiping action between the second wiper blade and the second printhead.

* * * * *